US012065894B2

(12) United States Patent
Zemla et al.

(10) Patent No.: US 12,065,894 B2
(45) Date of Patent: Aug. 20, 2024

(54) SYSTEM AND METHOD FOR NAVIGATING A WELLBORE AND DETERMINING LOCATION IN A WELLBORE

(71) Applicant: DynaEnergetics Europe GmbH, Troisdorf (DE)

(72) Inventors: Andreas Robert Zemla, Much (DE); Thilo Scharf, Letterkenny (IE); Liam McNelis, Bonn (DE); Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 83 days.

(21) Appl. No.: 17/869,946

(22) Filed: Jul. 21, 2022

(65) Prior Publication Data

US 2023/0025615 A1 Jan. 26, 2023

Related U.S. Application Data

(60) Provisional application No. 63/224,305, filed on Jul. 21, 2021.

(51) Int. Cl.
*E21B 23/00* (2006.01)
*E21B 47/092* (2012.01)

(52) U.S. Cl.
CPC ..... *E21B 23/001* (2020.05); *E21B 47/092* (2020.05)

(58) Field of Classification Search
CPC ..... E21B 47/09; E21B 47/092; E21B 23/001; E21B 23/08; E21B 43/117
See application file for complete search history.

(56) References Cited

U.S. PATENT DOCUMENTS

| | | | | |
|---|---|---|---|---|
| 7,363,967 | B2 | 4/2008 | Burris, II et al. | |
| 2002/0112856 | A1* | 8/2002 | Van Steenwyk .... | E21B 47/0228 166/66.5 |
| 2018/0135381 | A1* | 5/2018 | Tolman ..... | E21B 43/117 |

* cited by examiner

*Primary Examiner* — Nicole Coy
*Assistant Examiner* — Nicholas D Wlodarski
(74) *Attorney, Agent, or Firm* — Womble Bond Dickinson (US) LLP

(57) ABSTRACT

A wellbore positioning system includes a first wellbore casing element bearing a first magnetic pattern that encodes first information associated with the wellbore or a drone. The first wellbore casing element is configured for placement down-hole in the wellbore. The first wellbore casing element extends along a central axis and defines an axially oriented passage. Also, the system includes an untethered drone configured for relative movement in the passage of the first wellbore casing element. The drone is configured to detect the first magnetic pattern and determine a position of the drone within the wellbore based on the first information.

20 Claims, 20 Drawing Sheets

SYSTEM AND METHOD FOR NAVIGATING A WELLBORE AND DETERMINING LOCATION IN A WELLBORE

STATEMENT OF RELATED APPLICATIONS

This application claims priority to U.S. Provisional Application No. 63/224,305 filed Jul. 21, 2021, the contents of which are incorporated herein by reference.

FIELD OF THE DISCLOSURE

Devices, systems, and methods for navigating the downhole delivery of one or more wellbore tools in an oil or gas wellbore. More specifically, devices, systems, and methods for improving efficiency of downhole wellbore operations and minimizing debris in the wellbore from such operations.

BACKGROUND

Hydraulic Fracturing (or, "fracking") is a commonly-used method for extracting oil and gas from geological formations (i.e., "hydrocarbon formations") such as shale and tight-rock formations. Fracking typically involves, among other things, drilling a wellbore into a hydrocarbon formation; deploying a perforating gun including shaped explosive charges in the wellbore via a wireline; positioning the perforating gun within the wellbore at a desired area; perforating the wellbore and the hydrocarbon formation by detonating the shaped charges; pumping high hydraulic pressure fracking fluid into the wellbore to force open perforations, cracks, and imperfections in the hydrocarbon formation; delivering a proppant material (such as sand or other hard, granular materials) into the hydrocarbon formation to hold open the perforations and cracks through which hydrocarbons flow out of the hydrocarbon formation; and, collecting the liberated hydrocarbons via the wellbore.

In oil and gas wells, a wellbore 16, as illustrated in FIG. 1 is a narrow shaft drilled in the ground, vertically and/or horizontally deviated. A wellbore 16 can include a substantially vertical portion as well as a substantially horizontal portion and a typical wellbore may be over a mile in depth (e.g., the vertical portion) and several miles in length (e.g., the horizontal portion). The wellbore 16 is usually fitted with a wellbore casing that includes multiple segments (e.g., about 40-foot segments) that are connected to one another by couplers. A coupler (e.g., a collar), may connect two sections of wellbore casing.

In the oil and gas industry, a wireline, electric line or e-line are cabling technology used to lower and retrieve equipment or measurement devices into and out of the wellbore 16 of an oil or gas well for the purpose of delivering an explosive charge, evaluation of the wellbore 16 or other well-related tasks. Other methods include tubing conveyed (i.e., TCP for perforating) or coil tubing conveyance. A speed of unwinding a wireline cable 12 and winding the wireline cable back up is limited based on a speed of the wireline equipment 162 and forces on the wireline cable 12 itself (e.g., friction within the well). Because of these limitations, it typically can take several hours for a wireline cable 12 and toolstring 31 to be lowered into a well and another several hours for the wireline cable to be wound back up and the expended toolstring retrieved. The wireline equipment 162 feeds wireline 12 through wellhead 160. When detonating explosives, the wireline cable 12 will be used to position a toolstring 31 of perforating guns 18 containing the explosives into the wellbore 16. After the explosives are detonated, the wireline cable 12 will have to be extracted or retrieved from the well.

Wireline cables and TCP systems have other limitations such as becoming damaged after multiple uses in the wellbore due to, among other issues, friction associated with the wireline cable rubbing against the sides of the wellbore. Location within the wellbore is a simple function of the length of wireline cable that has been sent into the well. Thus, the use of wireline may be a critical and very useful component in the oil and gas industry yet also presents significant engineering challenges and is typically quite time consuming. It would therefore be desirable to provide a system that can minimize or even eliminate the use of wireline cables for activity within a wellbore while still enabling the position of the downhole equipment, e.g., the toolstring 31, to be monitored.

During many critical operations utilizing equipment disposed in a wellbore, it is important to know the location and depth of the equipment in the wellbore at a particular time. When utilizing a wireline cable for placement and potential retrieval of equipment, the location of the equipment within the well is known or, at least, may be estimated depending upon how much of the wireline cable has been fed into the wellbore. Similarly, the speed of the equipment within the wellbore is determined by the speed at which the wireline cable is fed into the wellbore. As is the case for a toolstring 31 attached to a wireline, determining depth, location and orientation of a tool string 31 within a wellbore 16 is typically a prerequisite for proper functioning.

One known means of locating an toolstring 31, whether tethered or untethered, within a wellbore involves a casing collar locator ("CCL") or similar arrangement, which utilizes a passive system of magnets and coils to detect increased thickness/mass in the wellbore casing 80 at portions where the coupling collars 90 connect two sections of wellbore casing 82, 84. A toolstring 31 equipped with a CCL may be moved through a portion of wellbore casing 80 having a collar 90. The increased wellbore wall thickness/mass at collar 90 results in a distortion of the magnetic field (flux) around the CCL magnet. This magnetic field distortion, in turn, results in a small current being induced in a coil; this induced current is detected by a processor/onboard computer which is part of the CCL. In a typical embodiment of known CCL, the computer 'counts' the number of coupling collars 90 detected and calculates a location along the wellbore 16 based on the running count.

Another known means of locating a toolstring 31 within a wellbore 16 involves tags attached at known locations along the wellbore casing 80. The tags, e.g., radio frequency identification ("RFID") tags, may be attached on or adjacent to casing collars but placement unrelated to casing collars is also an option. Electronics for detecting the tags are integrated with the toolstring 31 and the onboard computer may 'count' the tags that have been passed. Alternatively, each tag attached to a portion of the wellbore may be uniquely identified. The detecting electronics may be configured to detect the unique tag identifier and pass this information along to the computer, which can then determine current location of the toolstring 31 along the wellbore 16.

Knowledge of the location, depth and velocity of the toolstring in the absence of a wireline cable would be essential. The present disclosure is further associated with systems and methods of determining location along a wellbore 16 that do not necessarily rely on the presence of casing collars or any other standardized structural element, e.g., tags, associated with the wellbore casing 80.

BRIEF SUMMARY OF THE DISCLOSURE

The systems and methods described herein have various benefits in the conducting of oil and gas exploration and production activities.

In accordance with a first aspect, the disclosure relates to a wellbore positioning system. The system includes a first wellbore casing element bearing a first magnetic pattern that encodes first information associated with the wellbore or a drone. The first wellbore casing element is configured for placement down-hole in a wellbore. Also, the first wellbore casing element extends along a central axis and defines an axially oriented passage. Also, the system includes an untethered drone configured for relative movement in the passage of the first wellbore casing element. The drone is configured to detect the first magnetic pattern and determine a position of the drone within the wellbore based on the first information.

According to another aspect, the disclosure relates to a method of constructing a wellbore positioning system. The method includes providing a wellbore casing element above the surface of the wellbore. The wellbore casing element is configured for placement down-hole at specific position or distances in the wellbore. The wellbore casing element extends along a central axis and defines an axially oriented passage. Also, the method includes magnetizing at least a portion of the wellbore casing element to encode a magnetic pattern that includes information associated with the wellbore. Further, the method includes inserting the magnetized wellbore casing element into the wellbore.

BRIEF DESCRIPTION OF THE SEVERAL VIEWS OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
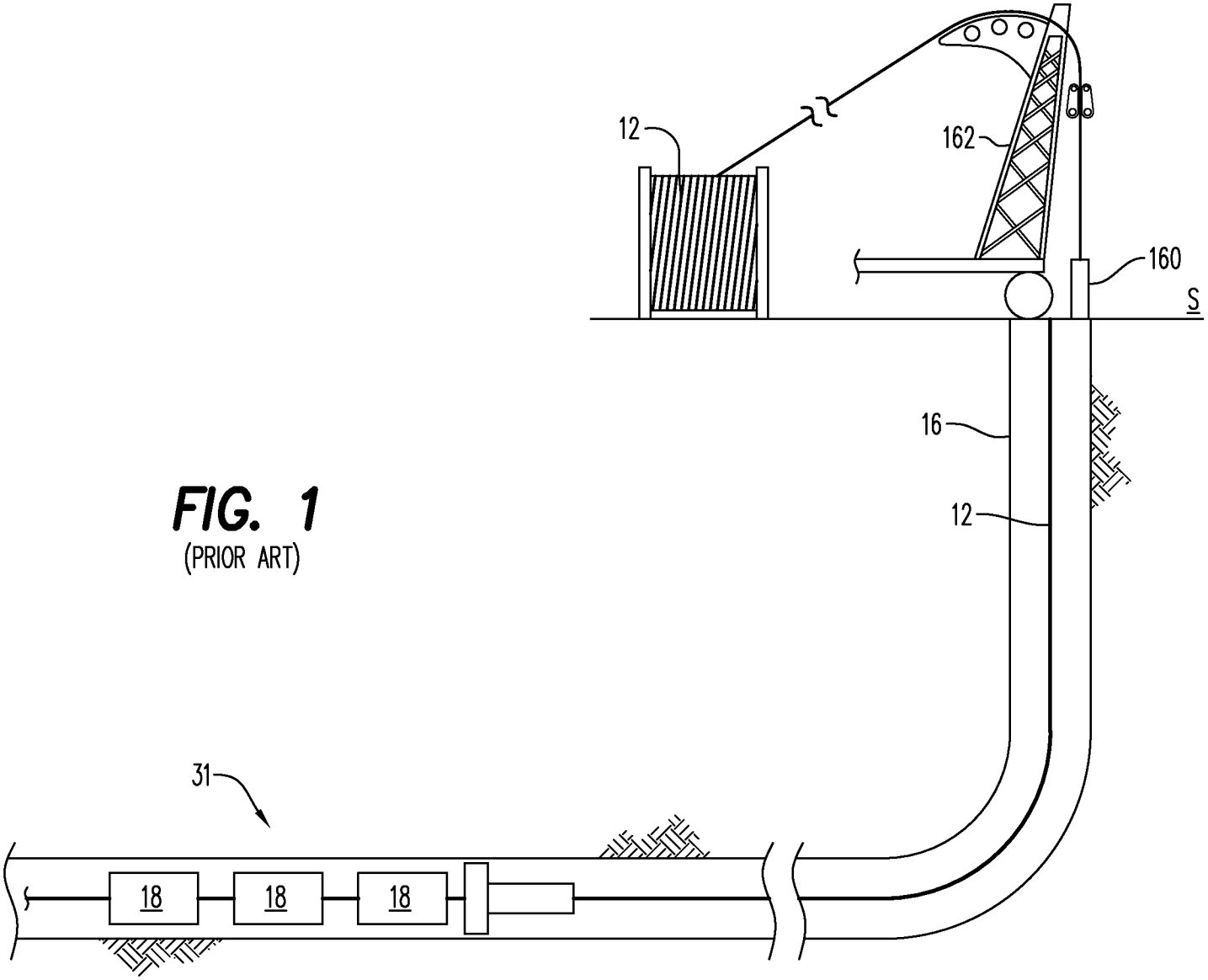
FIG. 1 (PRIOR ART)
FIG. 1 is a cross-sectional view of a wellbore and wellhead showing the prior art use of a wireline to place drones in a wellbore.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION OF THE EXEMPLARY EMBODIMENTS

Reference will now be made in detail to various exemplary embodiments. Each example is provided by way of explanation and is not meant as a limitation and does not constitute a definition of all possible embodiments.

As used herein, the term "anomaly" means an alteration in the physical characteristics in a particular area that will likely result in a changed signal received by a device traversing the particular area while actively or passively monitoring physical characteristics around said device. For example, in the event the device is travelling through a wellbore casing while monitoring the physical characteristics surrounding said device, structures such as a casing collar, a gap between adjacent wellbore casings, a thread joining the casing collar to the wellbore casing, an anomalous variation in the wellbore casing or a variation in magnetic field on or in the wellbore casing and a geological anomaly external to the wellbore casing, may cause a change in the signal(s) being monitored by the device. Each such structures would be considered an anomaly and the point along the path of the device where the signals are changed is referred to as an "anomalous point".

For purposes of this disclosure, an "untethered drone" is a self-contained, autonomous or semi-autonomous vehicle for downhole delivery of a wellbore tool that does not need to be tethered to a wireline in order for the wellbore tool to achieve its downhole function(s). More than one untethered drone may be connected together in a toolstring. The term "autonomous" means that the untethered drone is capable of performing its function(s) in the absence of receiving any instructions or signals after launch. The term "semi-autonomous" means that the untethered drone is capable of receiving instructions or signals after launch.

As mentioned above, one form of a wellbore tool is a perforating gun. It is contemplated that an untethered drone may include any wellbore tools, including but not limited to a perforation gun, puncher gun, logging tool, jet cutter, plug, frac plug, bridge plug, setting tool, self-setting bridge plug, self-setting frac plug, mapping/positioning/orientating tool, bailer/dump bailer tool and ballistic tool. Commonly owned U.S. Provisional App. No. 62/765,185, filed Aug. 20, 2018, which is incorporated herein in its entirety by reference, discloses an untethered drone.

This application incorporates by reference each of the following pending patent applications in their entireties: International Patent Application No. PCT/US2019/063966, filed May 29, 2019; U.S. patent application Ser. No. 16/423,230, filed May 28, 2019; U.S. Provisional Patent Application No. 62/842,329, filed May 2, 2019; U.S. Provisional Patent Application No. 62/841,382, filed May 1, 2019; International Patent Application No. PCT/IB2019/000526, filed Apr. 12, 2019; U.S. Provisional Patent Application No. 62/831,215, filed Apr. 9, 2019; International Patent Application No. PCT/IB2019/000530, filed Mar. 29, 2019; International Patent Application No. PCT/IB2019/000537, filed Mar. 18, 2019; U.S. Provisional Patent Application No. 62/816,649, filed Mar. 11, 2019; U.S. Provisional Patent Application No. 62/765,185, filed Aug. 16, 2018; U.S. Provisional Patent Application No. 62/719,816, filed Aug. 20, 2018; U.S. Provisional Patent Application No. 62/690,314, filed Jun. 26, 2018; U.S. Provisional Patent Application No. 62/678,654, filed May 31, 2018; and U.S. Provisional Patent Application No. 62/678,636, filed May 31, 2018.

Figure 2A:
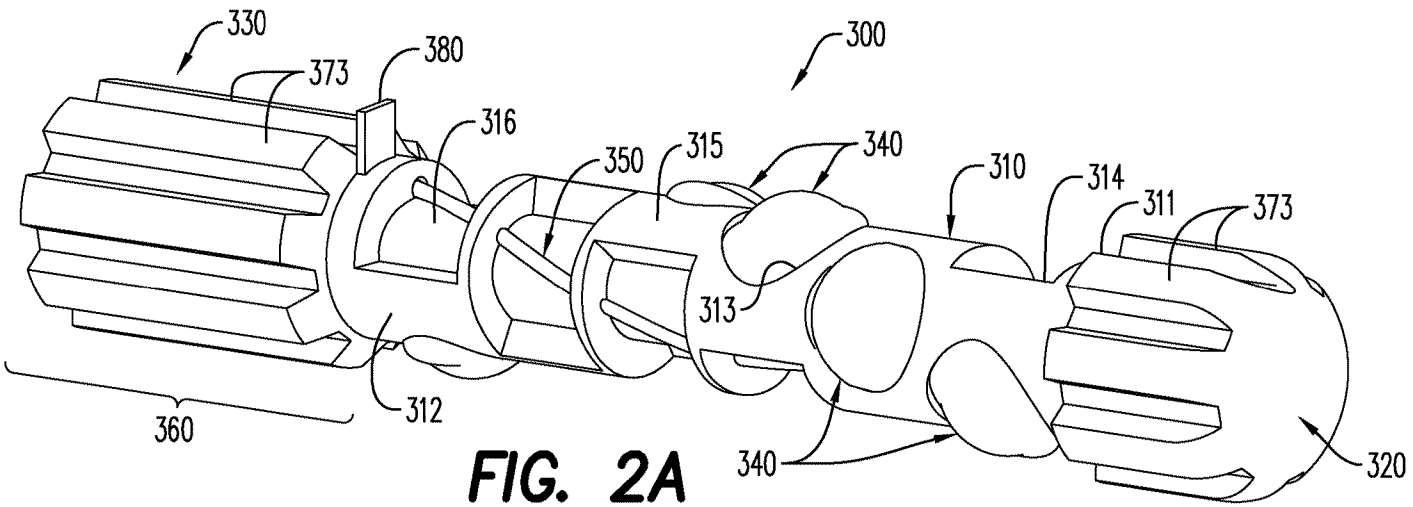
FIG. 2A is a perspective view of a drone in the form of a perforating gun.
Figure 2B:
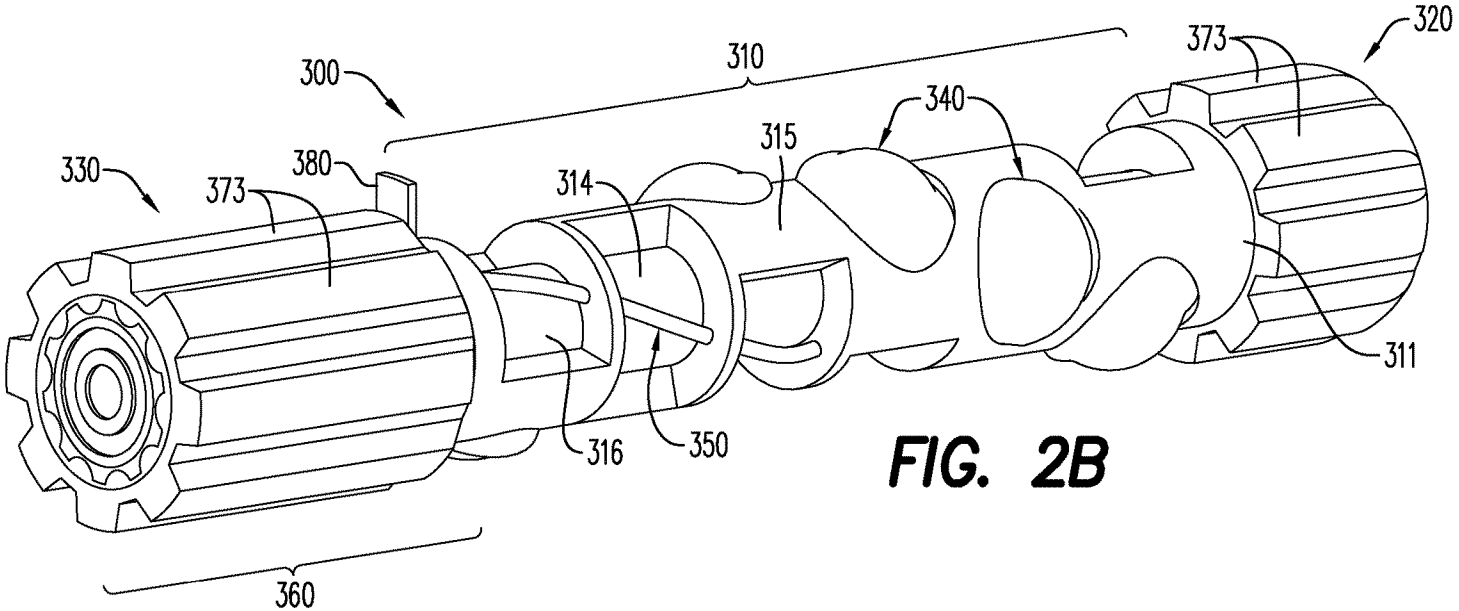
FIG. 2B is different perspective view of the drone of FIG. 2A.

With reference to FIGS. 2A and 2B, an exemplary embodiment is shown of an untethered drone 300 in the particular configuration of a perforating gun. As described herein, the untethered drone 300 may be launched autonomously or semi-autonomously into a wellbore 16, for delivering one or more wellbore tools downhole. The wellbore tool illustrated in FIGS. 2A and 2B is a perforating gun including a plurality of shaped charges 340. According to an aspect, the perforating gun may be connected to other wellbore tools, such as a bridge plug and a frac plug.

The exemplary untethered drone 300 shown in FIGS. 2A and 2B includes a body portion 310 having a front end 311 and a rear end 312. A head portion 320 extends from the front end 311 of the body portion 310 and a tail portion 330 extends from the rear end 312 of the body portion 310 in a direction opposite the head portion 320. It is to be noted here that the elimination of a tether in untethered drone 300, typically in the form of wireline cable 12, removes one of the key distinctions between the structure of the head portion 320 and tail portion 330. That is, an untethered drone does not include a tethering point on the tail portion. The absence of a tethering point offers the opportunity of loading either the head portion 320 or tail portion 330 first into the wellbore 16. Further, the head portion 320 and tail portion 330 could be essentially identical and loading direction of the drone rendered arbitrary. Further, an onboard computer/vehicle driver for powering and/or controlling the autonomous operation of the untethered drone 300 may be located in whole or variously in either the head portion 320 or the tail portion 330 depending on particular applications.

The body portion 310 of untethered drone 300, when in the form of a perforating gun, may include a plurality of shaped charge apertures 313 and open apertures 316 extending between an external surface 315 of the body portion 310 and an interior 314 of the body portion 310. Each of the plurality of shaped charge apertures 313 are configured for receiving and retaining a shaped charge 340. A detonating cord 350 for detonating the shaped charges 340 and relaying ballistic energy along the length of the untethered drone 300 may be housed within at least a portion of each of the body portion 310, the head portion 320, and the tail portion 330.

The detonating cord 350 may be configured as a conductive detonating cord and, additionally, for conveying non-detonation electrical signals, as described in U.S. Provisional Application No. 62/683,083 (filed Jun. 11, 2018), which is incorporated herein in its entirety.

The body portion 310, the head portion 320, and the tail portion 330 may be an injection-molded plastic or any other suitable material. Other such materials and associated methods of manufacture include casting (e.g., plastic casting and resin casting), metal casting, 3D printing, and 3D milling from a solid bar stock. Reference to the exemplary embodiments including injection-molded plastics is thus not limiting. An untethered drone 300 formed according to this disclosure leaves a relatively small amount of debris in the wellbore post perforation. Further, the materials may include metal powders, glass beads or particles, known proppant materials, and the like that may serve as a proppant material when the shaped charges 340 are detonated. In addition, the materials may include, for example, oil or hydrocarbon-based materials that may combust and generate pressure when the shaped charges 340 are detonated, synthetic materials potentially including a fuel material and an oxidizer to generate heat and pressure by an exothermic reaction, and materials that are dissolvable in a hydraulic fracturing fluid.

In the exemplary disclosed embodiments, the body portion 310 is a unitary structure that may be formed from an injection-molded material. In the same or other embodiments, at least two of the body portion 310, the head portion 320, and the tail portion 330 are integrally formed from an injection-molded material. In other embodiments, the body portion 310, the head portion 320, and the tail portion 330 may constitute modular components or connections.

Each of the body portion 310, the head portion 320, and the tail portion 330 is substantially cylindrically-shaped and may include a central cavity in which various drone components may be located. The relationship between the outer shell and central cavity may be such that the internal components of the untethered drone 300 are protected from exposure to the contents and conditions of the wellbore 16, e.g., high temperature and fluid pressures, during the descent of the untethered drone 300 into the wellbore 16. Each of the head portion 320 and the tail portion 330 may include fins 373 configured for, e.g., reducing friction and inducing rotational speed during the descent of the untethered drone 300 into the wellbore 16.

With continuing reference to FIGS. 2A and 2B, each of the plurality of shaped charge apertures 313 in the body portion 310 may receive and retain a portion of a shaped charge 340 in a corresponding hollow portion (unnumbered) of the interior 314 of the body portion 310. Another portion of the shaped charge 340 remains exposed to the surrounding environment. Thus, the body portion 310 may be considered in some respects as an exposed charge carrier, and the shaped charges 340 may be encapsulated, pressure sealed shaped charges having a lid or cap. The plurality of open apertures 316 may be configured for, among other things, reducing friction against the body portion 310 as the untethered drone 310 is conveyed into a wellbore 16 and/or for enhancing the collapse/disintegration properties of the body portion 310 when the shaped charges 340 are detonated.

The interior 314 of the body portion 310 may have hollow regions and non-hollow regions. The hollow portion of the interior 314 may include one or more structures for supporting each of the shaped charge 340 in the shaped charge apertures 313. The supporting structure may support, secure, and/or position the shaped charge 340 and may be formed from a variety of materials in a variety of configurations consistent with this disclosure. For example and without limitation, the supporting structure may be formed from the same material as the body portion 310 and may include a retaining device such as a retaining ring, clip, tongue in groove assembly, frictional engagement, etc., and the shaped charge 340 may include a complimentary structure to interact with the supporting structure.

In an aspect and with continuing reference to FIGS. 2A and 2B, the body portion 310, head portion 320 and tail portion 310 of the untethered drone 300 may house a line (not shown) for relaying electrical current and/or signals along the length of the untethered drone 300, as discussed further below. The untethered drone 300 may also include a deactivating safety device 380 that must be actuated or removed prior to certain operations/functions of the drone being enabled.

Ultrasonic transducers are a type of acoustic sensor that may include both a transmitter of ultrasound signals and a receiver of ultrasound signals. When both are included in a single ultrasound transducer, the unit is referred to as a transceiver. An ultrasound transmitter converts electrical signals into an ultrasound signal and directs the ultrasound signal in one or more directions. Ultrasound receivers have an element that receives an ultrasound signal and converts ultrasound waves received into electrical signals. There are several ways the transmitter and receiver parts can be oriented on the transducer; they can be on opposite ends of the transducers, or both devices can be located on the same end and same side. A computer/processor associated with the ultrasound transducer may be programmed to both produce the transmitted ultrasound signal and interpret the received ultrasound signal. Similar to radar and sonar, ultrasonic transducers evaluate targets by directing sound waves at the target and interpreting the reflected signals.

Figure 3B:
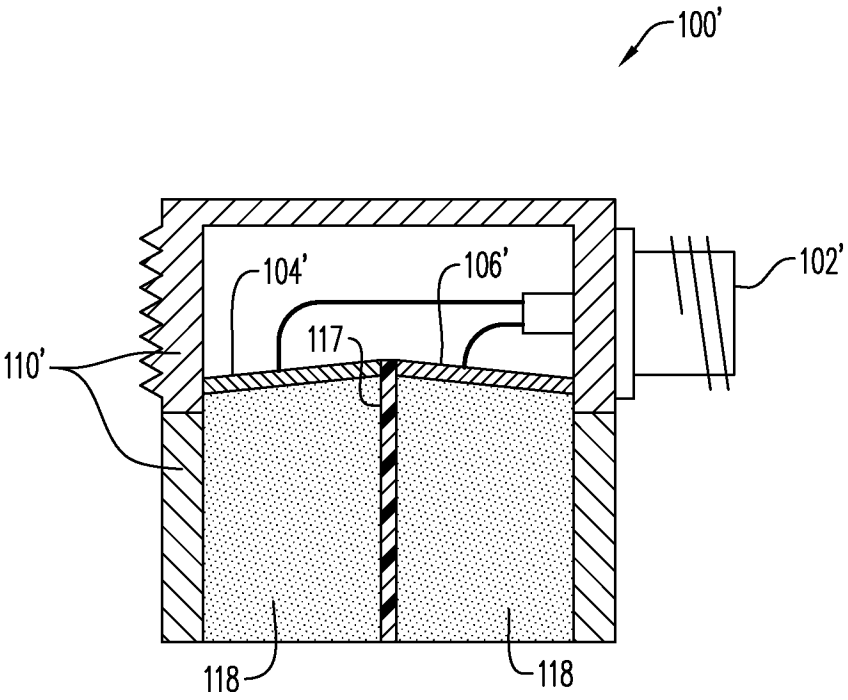
FIG. 3B is a cross-sectional, side plan view of an ultrasonic transceiver utilized in an embodiment.
Figure 3A:
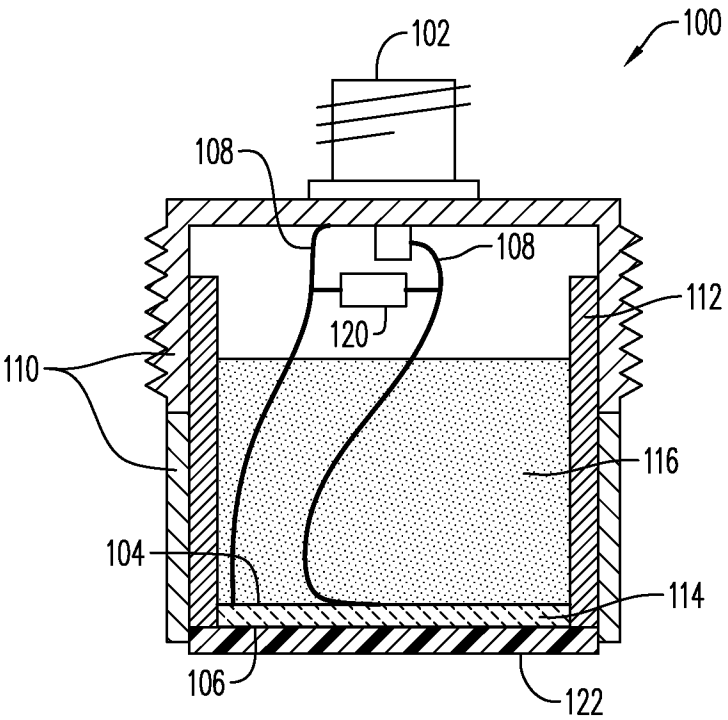
FIG. 3A is a cross-sectional, side plan view of an ultrasonic transceiver utilized in an embodiment.

FIG. 3A is a cross-section of an ultrasonic transducer 100 that may be used in a system and method of determining location along a wellbore 16 (as seen, for instance, in FIG. 1). The transducer 100 may include a housing 110 and a connector 102; the connector 102 is the portion of the housing 110 allowing for connections to the computer/processor (see, for instance, FIG. 4) that generates and interprets the ultrasound signals. The key elements of the transducer 100 are the transmitting element 104 and the receiving element 106 that are contained in the housing 110. In the transducer shown in FIG. 3A, the transmitting/receiving elements 104/106 are integrated into a single active element 114. That is, active element 114 is configured to both transmit an ultrasound signal and receive an ultrasound signal. Electrical leads 108 are connected to electrodes on the active element 114 and convey electrical signals to/from the computer/processor. An electrical network 120 may be connected between the electrical leads 108 for purposes of matching electrical impedance and other signal processing requirements of ultrasound equipment. Optional elements of a transducer include a sleeve 112, backing 116 and a cover/wearplate 122 protecting the active element 114.

FIG. 3B is a cross-section of an alternative version of an ultrasonic transducer 100' that may be used in a system and method of determining location along a wellbore 16. The transducer 100' may include a housing 110' and a connector 102'; the connector 102' is the portion of the housing 110' allowing for connections to the computer/processor that generates and interprets the ultrasound signals. The key elements of the transducer 100' are the transmitting element 104' and the receiving element 106' that are contained in the housing 110'. A delay material 118 and an acoustic barrier 117 are provided for improving sound transmission and receipt in the context of a separate transmitting element 104 and receiving element 106 apparatus.

Figure 4:
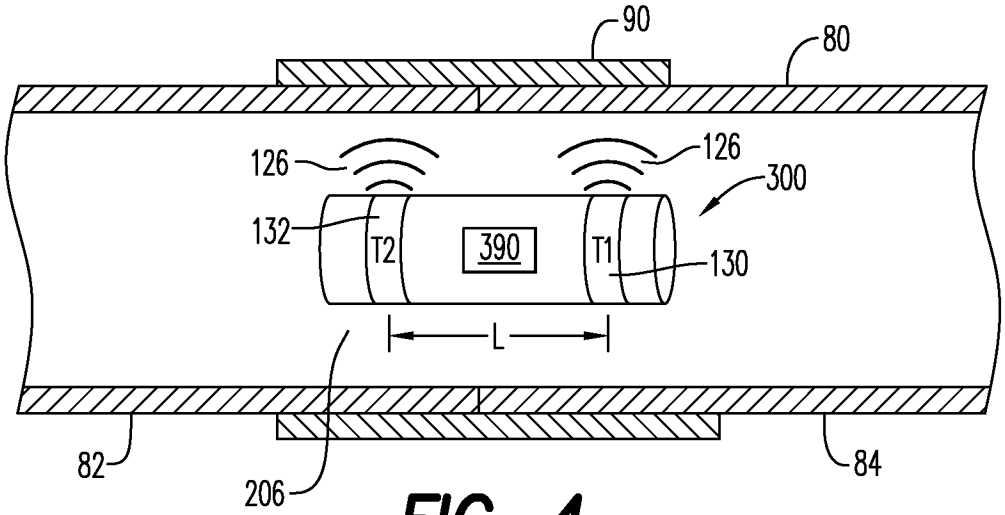
FIG. 4 is a cross-sectional plan view of a two ultrasonic transceiver based navigation system of an embodiment.

Ultrasonic transducers 100 may be used to determine the speed of an untethered drone 300 traveling down a wellbore 16 by identifying ultrasonic waveform changes. As depicted in FIG. 4, an untethered drone 300 may be equipped with one or more ultrasonic transducers 100. In an embodiment, the untethered drone 300 has a first transducer 130 (also marked T1) and a second transducer 132 (also marked T2), one at each end of the untethered drone 300. The distance separating the first transducer 130 from the second transducer 132 is a constant and may be referred to as distance 'L'. Each transducer 130, 132 may have a transmitting element 104 and a receiving element 106 (as shown in FIGS. 3A and 3B) that sends/receives signals radially from the untethered drone 300. In an embodiment, each transmitting element 104 and receiving element 106 may be disposed about an entire radius of the untethered drone 300; such an arrangement permits the elements 104, 106 to send/receive signals about essentially the entire radius of the untethered drone 300.

Figure 5:
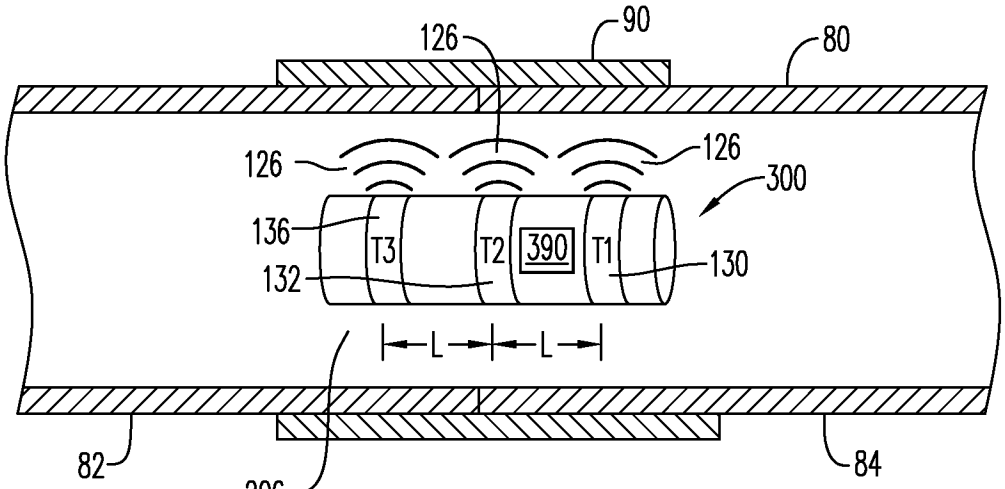
FIG. 5 is a cross-sectional plan view of a three ultrasonic transceiver based navigation system of an embodiment.

FIG. 4 illustrates an untethered drone 300 that includes the first ultrasonic transceiver 130 and the second ultrasonic transceiver 132. Each ultrasonic transceiver 130, 132 is capable of detecting alterations in the medium through which the untethered drone 300 is traversing by transmitting an ultrasound signal 126 and receiving a return ultrasound signal 128 (see FIG. 6). Although only the transmitted ultrasound signal 126 is shown in FIGS. 4 and 5, the ultrasonic transceivers utilized are both transmitting and receiving ultrasound signals 126, 128 in an effectively constant manner. Changes in the material and geometry of wellbore casing 80 and other material external to wellbore casing 80 will often result in a substantial change in the return ultrasound signal 128 received by receiving element 106 and conveyed to computer/processor 390. Such changes may involve the transition from a first casing portion 82 to a second casing portion 84, including a casing collar 90 that may be present at such a transition. More generally and, as will be presented hereinbelow, the changes in the material/geometry may be referred to as an anomalous point 206.

Figure 9:
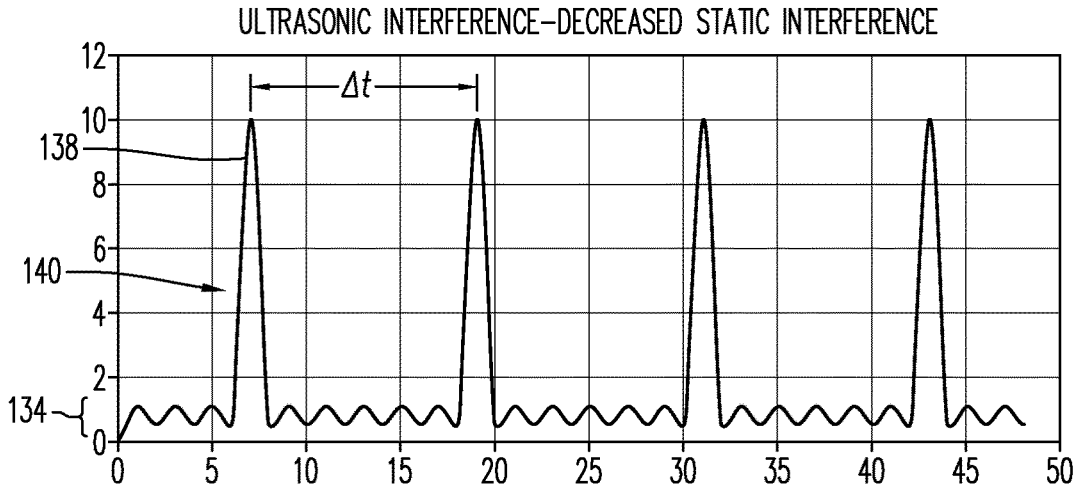
FIG. 9 is a graphical representation of a return electrical signal based on a return ultrasound signal received by the receiving element of an ultrasonic transceiver.

FIG. 9 presents an example of a return electrical signal 140 input to and/or output from computer/processor 390 based on the return ultrasound signal 126 received by the receiving element 106 of ultrasonic transceiver 100. The x-axis of FIG. 9 is time and the y-axis may be any one of a number of optional measurements utilized in ultrasound transducer technology. For the purposes of this disclosure, it may be assumed that the y-axis is some measure of signal strength of the return ultrasound signal 126 or some selected, i.e., filtered, portion thereof. That is, with reference also to FIGS. 3A and 3B, the transmitting element 104 of transducer 100 emits a transmitted ultrasound signal 126 into the material external to the untethered drone 300 and a portion of this transmitted ultrasound signal 126 is reflected by various portions of the material external to the untethered drone 300; the reflected ultrasound waves may be referred to as the return ultrasound signal 128. The return ultrasound signal 128 is received by the receiving element 106 and a signal is sent by receiving element 106 to computer/processor 390. The return electrical signal 140 is either the signal sent by the receiving element 106 to the computer/processor 390 or that signal modified by filters and/or software of the computer/processor 390. Either way, it is an electrical representation of the return ultrasound signal 128.

Interpretation of the return electrical signal 140 may be performed at least partially by inference, based on the known changes in the medium through which the ultrasound transceiver 100 is passing. For example, in the event that the return electrical signal 140 of FIG. 9 is received from a transceiver 100 passing through a wellbore 16 at a constant velocity and this velocity would have caused transceiver 100 to pass through about four casing collars 90 in the measured time period, i.e., y-axis, some inferences may be made. It may be inferred that the base return signal 134 represents the return ultrasound signal 128 when the transceiver 100 is passing through only the wellbore casing 80 that is not covered by a casing collar 90, i.e., the majority of the wellbore. Return signal 134 may also be considered to represent 'noise' or, essentially, no signal of significance. It may also be inferred that each modified return signal 138, equally spaced in time, represents the return ultrasound signal 128 when the transceiver 100 is passing through a portion of the wellbore casing 80 at the point where it is connected to the next wellbore casing 80 by a casing collar 90.

Figure 10:
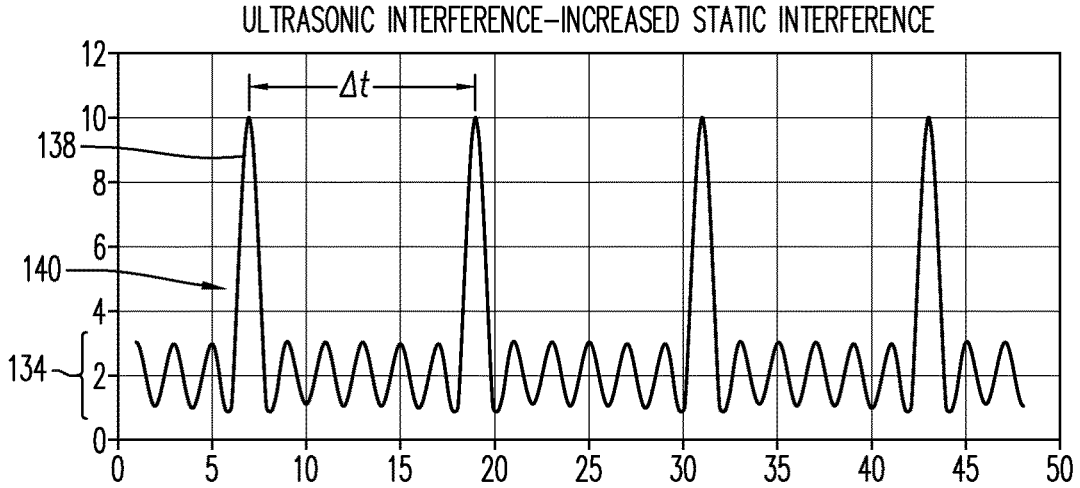
FIG. 10 is a graphical representation of a return electrical signal based on a return ultrasound signal received by the receiving element of an ultrasonic transceiver.
Figure 10A:
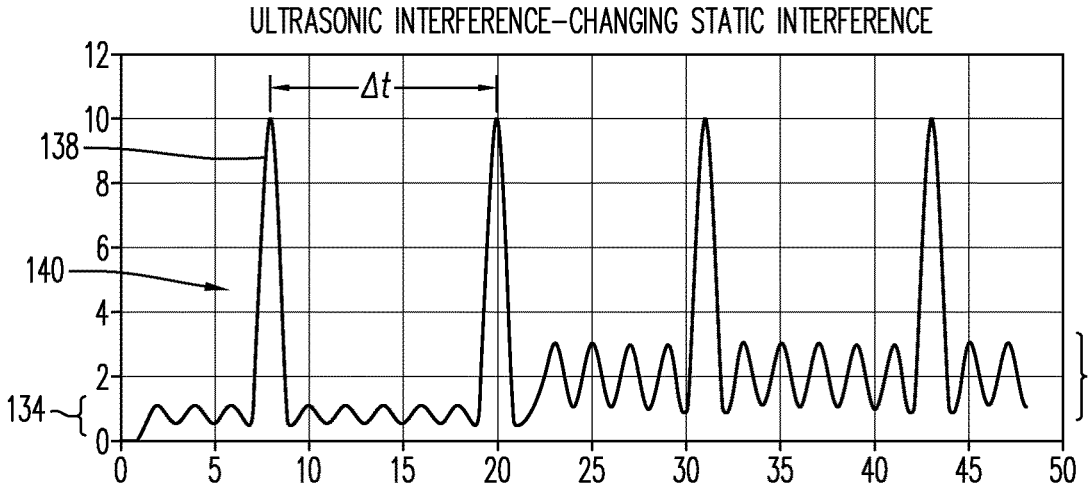
FIG. 10A is a graphical representation of a return electrical signal based on a return ultrasound signal received by the receiving element of an ultrasonic transceiver.

FIG. 10 and FIG. 10A are two additional examples of a return electrical signal 140 input to and/or output from computer/processor 390 based on the return ultrasound signal 126 received by the receiving element 106 of ultrasonic transceiver 100. FIG. 10 illustrates an example where the base return signal 134, i.e., potential noise, is substantially greater than in FIG. 9, although the modified return signal 138 remains easily identifiable. FIG. 10A illustrates an example where the base return signal 134 is variable in strength.

In an embodiment, a navigation system 10 may include one or more ultrasonic transceivers 100 or T1, T2, T3, etc., connected to a computer/processor 390. The navigation system 10 may be provided on or installed in the associated structures of the untethered drone 300. The worker skilled in the art knows that integration of the navigation system 10 with the untethered drone 300 is a straightforward matter, especially in light of the disclosure provided herein. Similarly, the onboard computer/processor 390 may be a part of the navigation system 10 or the navigation system 10 may supply information or electrical signals to the onboard computer/processor 390. The elements of the navigation system 10 may be contained in the body portion 310, head portion 320 or tail portion 330 of the untethered drone 300. Alternatively, the different elements of the navigation system 10 may be spread across the various elements of the untethered drone 300 with electrical connections therebetween, as appropriate. To the extent that placement of portions of the navigation system 10 are material to the functioning thereof, such placement is described in further detail hereinbelow.

While the ultrasound embodiment of navigation system 10 presented herein may be used to detect the differences in the metal thickness between a typical pipe section 80 and a pipe section encompassed by a collar 90, it uses a different physical principle than traditional/standard casing collar locator ("CCL") systems. That is, the ultrasound transceiver 100 may be substantially different in a number of respects from a known CCL. Further, ultrasound transceivers 100 are not necessarily limited to detecting casing collars 90 along the length of wellbore 16. Other anomalous points may result in a modified return signal 138 to the ultrasound transceiver 100 sufficient to be noticed above the base return signal 134. Such anomalous points may be inside the wellbore 16, associated with the pipe section or other structural components of the wellbore 16. In addition, anomalous points external to the wellbore 16, i.e., native to the geological formation through which the wellbore 16 passes, may also return a sufficient modified return signal 138. As will be further described hereinbelow, the precise nature of an anomaly is not of great importance to embodiments described in this application. Rather, the existence and repeatability of a modified return signal 138, especially the latter, are of far greater utility to the described embodiments.

In the embodiment shown in FIG. 4, the navigation system 10 includes two ultrasonic transceivers 100, identified as T1 and T2. Besides acting as a verification of T1 passing a change in physical properties, i.e., an anomaly, second transceiver T2 enables an important function of navigation system 10. Since T2 is axially displaced from T1 along the long axis of untethered drone 300, T2 passes through an anomaly in wellbore 16 at a different time than T1 as untethered drone 300 traverses the wellbore 16. Put another way, assuming the existence of an anomalous point 206 along the wellbore, T1 and T2 pass the anomalous point 206 in wellbore 16 at slightly different times. In the event that T1 and T2 both register a sufficiently strong and identical, i.e., repeatable, modified return signal 138 as a result of an anomaly at the anomalous point 206, it is possible to determine the time difference between T1 registering the anomaly at the anomalous point 206 and T2 registering the same anomaly. The distance L between T1 and T2 being a known, a sufficiently precise measurement of time between T1 and second T2 passing a particular anomaly provides a measure of the velocity of the navigation system 10, i.e., velocity equals change in position divided by change in time. Utilizing the typically safe presumption that an anomaly is stationary, the velocity of the untethered drone 300 through the wellbore 16 is available every time the untethered drone 300 passes an anomaly that returns a sufficient change in amplitude for each of T1 and T2.

As mentioned previously, the potential exists for locating ultrasonic transceiver T1 and ultrasonic transceiver T2 in different portions of untethered drone 300 and connecting them electrically to computer/processor 390. As such, it is possible to increase the axial distance L between T1 and T2 almost to the limit of the total length of untethered drone 300. Placing T1 and T2 further away from one another achieves a more precise measure of velocity and retains precision more effectively as higher drone velocities are encountered, especially where sample rate for T1 and T2 reach an upper limit.

Further to the foregoing, the return electrical signal 140 is based on the return ultrasound signal 126 received by the receiving element 106 of ultrasonic transceiver 100. A separate return electrical signal 140 exists for each of T1 and T2. These two return electrical signals 140 may be compared by onboard computer 390 to identify sufficiently identical modified return signals 138. Potentially, signal processing, amplifying and filtering circuitry may be integrated with the onboard computer/processor 390 to optimize this comparison. In an embodiment, the critical data point achieved by the comparison of the two return electrical signals 140 from T1 and T2 is the time between one transceiver identifying a particular anomaly and the other transceiver identifying the same anomaly.

In another embodiment, illustrated in FIG. 4, a third ultrasonic transceiver 136 is added to the untethered drone 300 navigation system 10. This third transceiver 136 is designated T3. The onboard computer/processor 390 may now be provided with three distinct return electrical signals 140 for detecting anomalous points. The fact that the distance L between adjacent transceivers, i.e., T1 to T2 and T2 to T3, is reduced is not of particular importance since the larger distance between T1 and T3 may also still be utilized by the computer/processor. Thus, although adjacent transceivers 200 may certainly be utilized by computer/processor 390 in spite of the shortened axial displacement between them, the primary usefulness of the third or higher order transceiver is further confirmation that a particular modified return signal 138 for an anomaly is truly identical and repeatable between transceivers 200.

Figure 6:
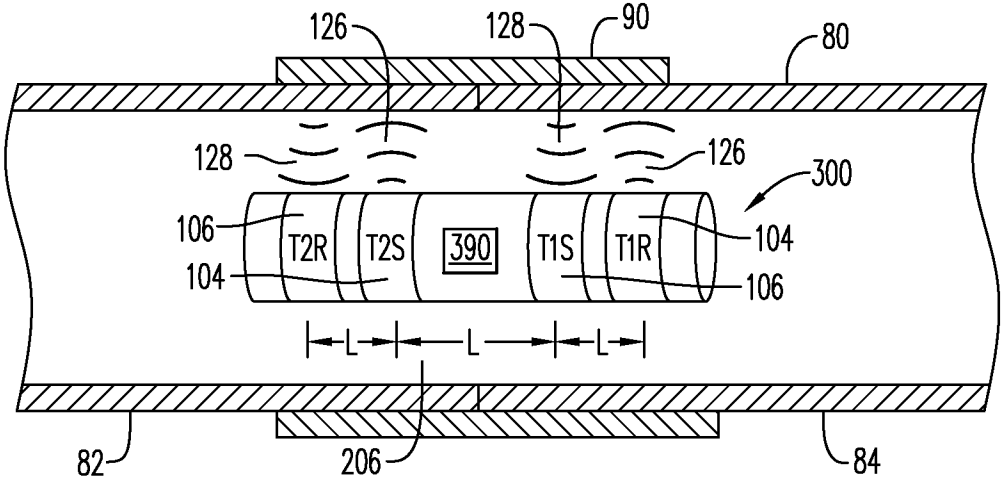
FIG. 6 is a cross-sectional plan view of a two ultrasonic transmitter and two ultrasonic receiver based navigation system of an embodiment.

A further embodiment is illustrated in FIG. 6 and shows a system where the ultrasonic transducers 200 have the transmitters T1S, T2S separate from the receivers T1R, T2R. Other than some slight modifications to account for the offsets between the transmitters and receivers, the embodiment of FIG. 6 operates in the same way as integrated embodiments.

Figure 7:
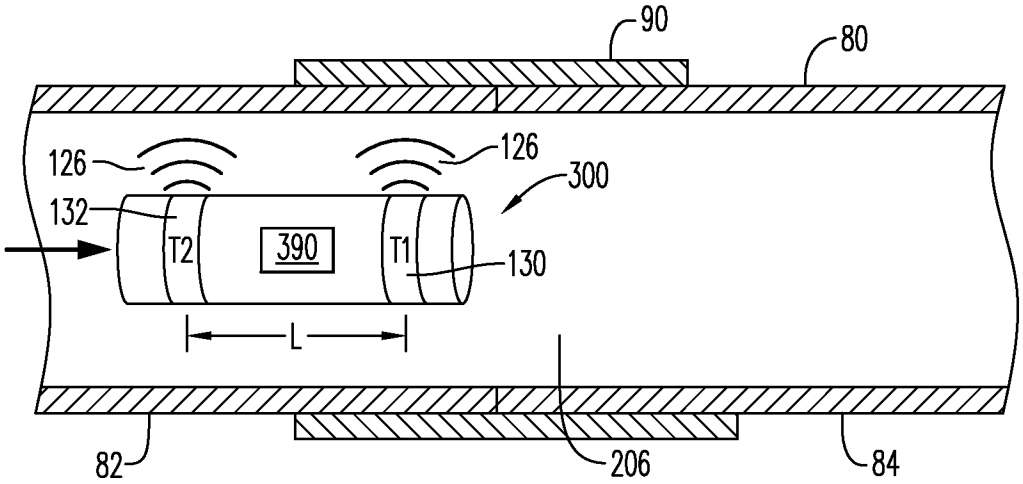
FIG. 7 is a cross-sectional plan view of the FIG. 4 embodiment with transceiver T1 adjacent an anomalous point 206 in wellbore 16.
Figure 8:
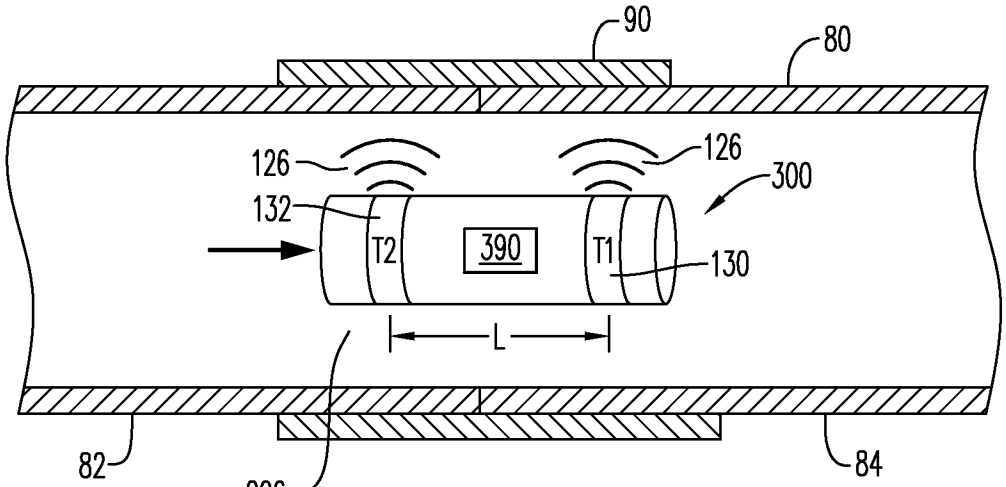
FIG. 8 is a cross-sectional plan view of the FIG. 4 embodiment with transceiver T2 adjacent an anomalous point 206 in wellbore 16.

FIG. 7 and FIG. 8 illustrate the movement of an untethered drone 300 having a navigation system 10 that includes ultrasonic transceivers T1 and T2 in a wellbore 16. The anomalous point 206 may be considered the location at which the return electrical signals 140 of each of T1 and T2, as seen in FIGS. 9 and 10, register a sufficiently strong and identical modified return signal 138. The time it takes for untethered drone 300 to move from its location shown in FIG. 7 to its location shown in FIG. 8, measured by the computer/processor 390, may be converted into a velocity by dividing L by the measured time.

Figure 11:
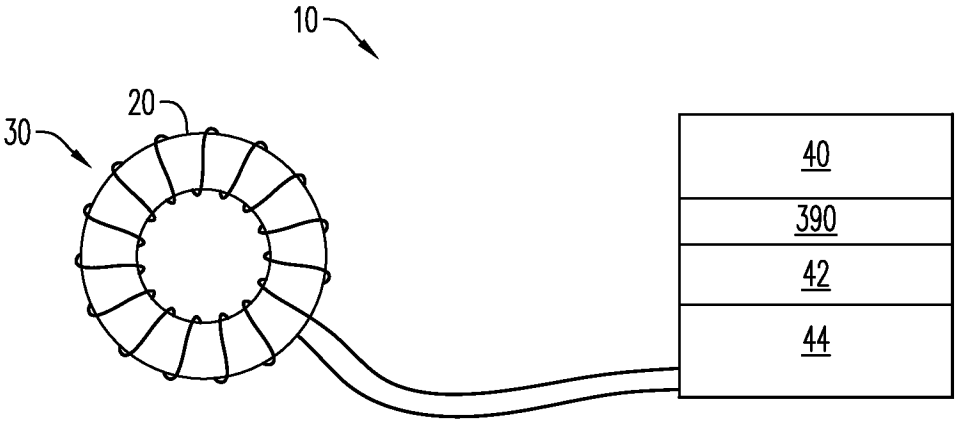
FIG. 11 is a plan view of a simplified version of a navigation system of an embodiment.

FIG. 11 illustrates another embodiment of the navigation system 10 that includes active oscillator circuit for detecting alterations in the medium through which the untethered drone 300 is traversing. The navigation system 10 may be provided on or installed in the associated structures of the untethered drone 300. The worker skilled in the art knows that integration of the navigation system 10 with the untethered drone 300 is a straightforward matter, especially in light of the disclosure provided herein. Similarly, the onboard computer/processor 390 may be a part of the navigation system 10 or the navigation system 10 may supply information or electrical signals to the onboard computer/processor 390. The elements of the navigation system 10 may be contained in the body portion 310, head portion 320 or tail portion 330 of the untethered drone 300, see FIG. 2. Alternatively, the different elements of the navigation system 10 may be spread across the various elements of the untethered drone 300 with electrical connections therebetween, as appropriate. To the extent that placement of portions of the navigation system 10 are material to the functioning thereof, such placement is described in further detail hereinbelow.

While the navigation system 10 described herein may be used to detect the differences in the metal thickness between a typical pipe section 80 and a pipe section encompassed by a collar 90, it uses a different physical principle than traditional/standard CCL systems. The navigation system 10 utilizes a signal generating and processing unit 40 attached to a wire coil 30. The wire coil 30 may be wrapped around a core 20. According to an aspect, the core 20 is made of a material that is highly permeable to magnetic fields, such high permeability materials including at least one of ferrite, laminated iron and iron powder. The magnetic field strength of the wire coil 30 is greatly increased with the use of the core 20 having high permeability. The core 20 may be of any shape, such as the toroidal shape shown in FIG. 11 and FIG. 12.

The navigation system 10 further includes a signal generating and processing unit 40. The processing unit may include an oscillator 44 and a capacitor 42. An oscillating signal is generated by the oscillator 44 and sent to the wire coil 30. With the wire coil 30 acting as an inductor, a magnetic field is established around the wire coil 30 when charge flows through the coil 30. Insertion of a capacitor 42 in the circuit results in constant transfer of electrons between the coil/inductor 30 and capacitor 42, i.e., in a sinusoidal flow of electricity between the coil 30 and the capacitor 42. The frequency of this sinusoidal flow will depend upon the capacitance value of capacitor 42 and the magnetic field generated around coil 30, i.e., the inductance value of coil 30. The peak strength of the sinusoidal magnetic field around coil 30 will depend on the materials immediately external to coil 30. With the capacitance of capacitor 42 being constant and the peak strength of the magnetic field around coil 30 being constant, the circuit will resonate at a particular frequency. That is, current in the circuit will flow in a sinusoidal manner having a frequency, referred to as a resonant frequency, and a constant peak current.

When the signal processing unit 40 and the coil 30 are moved through a material and/or moved past structures that do not alter the magnetic field around coil 30, current will flow through the circuit with a resonant frequency and an unchanged amplitude. For example, a coil passing through a pipe filled with an essentially homogenous fluid, where the pipe is surrounded by essentially homogenous material (soil, rock, etc.) and further wherein the dimensions of the pipe are constant along its length, will have constant inductance because the magnetic permeability of materials around the coil will be constant. However, when coil 30 is moved through a material and/or past structures that do impact the magnetic field around coil 30, i.e., past or through an object having different magnetic permeability, the inductance value of coil 30 is altered and, thus, the resonant frequency is changed.

The above description describes a passive circuit, i.e., a circuit that is charged with electrons and current then flows between the capacitor 42 and coil (inductor) 30 with a particular frequency. In an active circuit, electron flow may be imposed on the same capacitor/inductor circuit by an oscillator 44. The frequency of the circuit will not be affected by the capacitance and inductance values present in the circuit, since they are driven by the oscillator 44. In an active circuit, what will instead be altered by a change in the inductance value of the inductor is the maximum peak current. That is, when the inductance value is the only change in the circuit and the frequency of the sinusoidal signal is kept constant, it is the amplitude of the signal that will be increased or decreased.

Figure 12:
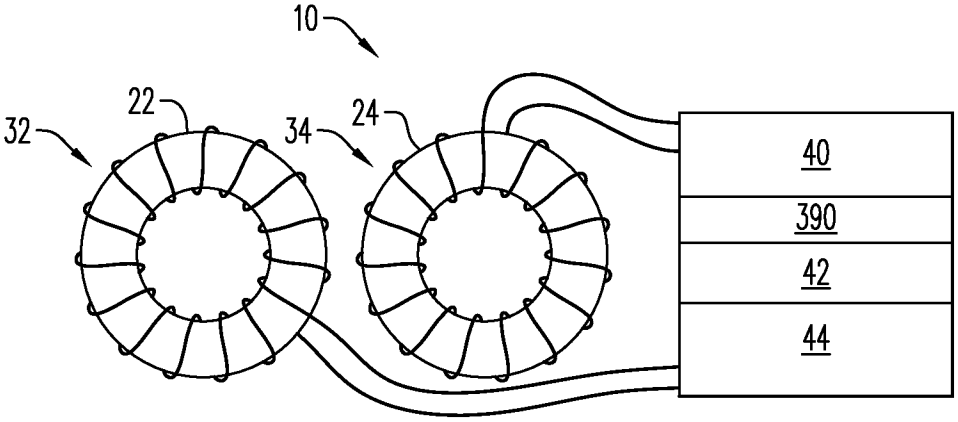
FIG. 12 is a plan view of a navigation system of an embodiment.

In an embodiment of the navigation system 10 described herein, two coils are used. As seen in FIG. 12, the signal generating and processing unit 40 is attached to both ends of a first coil 32 wrapped around a first core 22 of high magnetic permeability material as well as both ends of a second coil 34 wrapped around a second core 24 or high magnetic permeability material. As discussed previously, although the cores 22, 24 and coils 32, 34 are presented in FIG. 12 as toroidal in shape, although other shapes are possible. An exemplary embodiment of the present disclosure has the first coil 32 and the second coil 34 configured coplanar to one another. Since a toroidal coil defines a plane, the magnetic field established by such a coil possesses a structure related to this plane. Changes in magnetic permeability occurring coplanar to the plane of the toroidal coil will have greater effect on the coil's inductance than changes that are not coplanar. Changes in magnetic permeability in a plane perpendicular to the plane of the coil may have little to no impact on the coil's inductance value. As will be discussed hereinbelow, embodiments of the present disclosure may register the same anomaly, i.e., change in magnetic permeability, once for each coil. In this configuration, having the coils 32, 34 disposed on the same plane may achieve this result.

Besides being coplanar, embodiments of the present disclosure may require the first coil 32 and second coil 34 to be displaced axially with respect to one another. The axis in question is the long axis of the drone which should, typically, be substantially identical to the axes of the wellbore 16 and the wellbore casing 80. The utility of the axial displacement of the coils 32, 34 will be apparent from the description hereinbelow.

The frequency and amplitude output by the oscillating circuitry can be adjusted to the applicable geometry of the wellbore casing pipes 80, which come in a number of diameters, e.g., 4.5", 5.5" or 6" outside diameter. For purposes to be discussed hereinbelow, the frequency output by the oscillating circuitry may also be adjusted based on the velocity at which the untethered drone 300 containing the wellbore navigation system 10 is travelling through the wellbore 16. Wellbore casing pipes are typically joined together by a casing collar 90.

For a given frequency and power level output by the oscillator 44 and a known, constant capacitance for capacitor 42, the variable in the electrical circuit including the first coil 32 is the inductance value of the first coil 32. Since this inductance value is, in turn, dependent on the magnetic permeability of the materials surrounding first coil 32, changes in the magnetic permeability of the materials surrounding first coil 32 may cause a change in the flow of electricity in the electrical circuit of which the first coil 32 is a part. Since, as stated, the frequency is determined by the oscillator 44, the change in the oscillating current takes the form of a change in amplitude, i.e., the peak current through the circuit will vary. Therefore, a change in the magnetic permeability of the materials surrounding the first coil 32 will result in the inductance value of first coil 32 changing; this changed inductance value results in a change in the peak current of the circuit. The same is true for the second coil 34.

Figure 13:
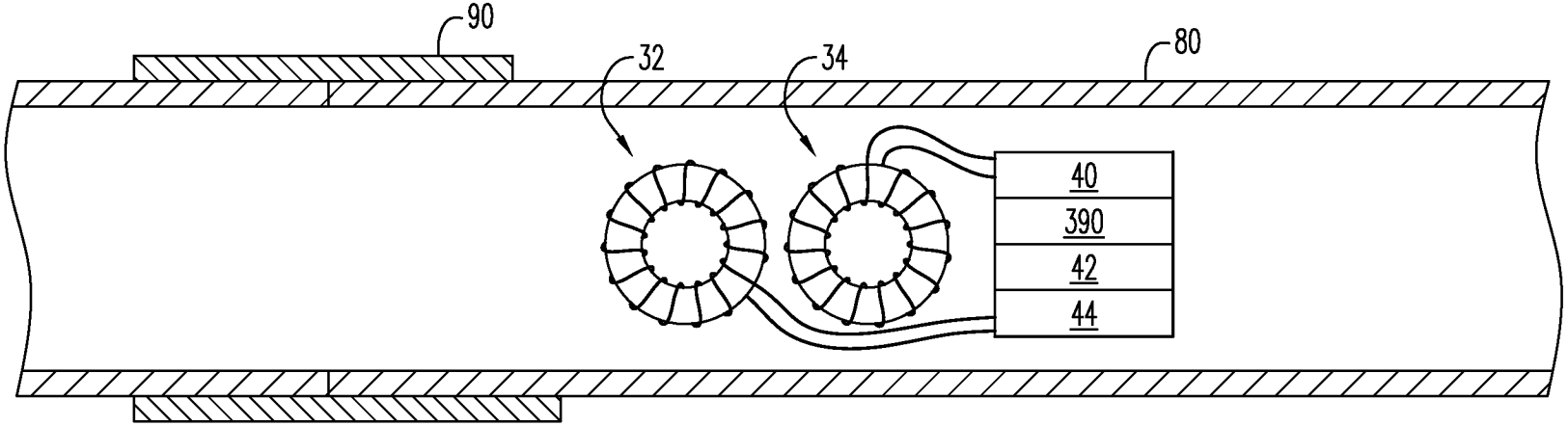
FIG. 13 is a cross-sectional plan view of the navigation system of FIG. 4 disposed in a section of wellbore casing.
Figure 14:
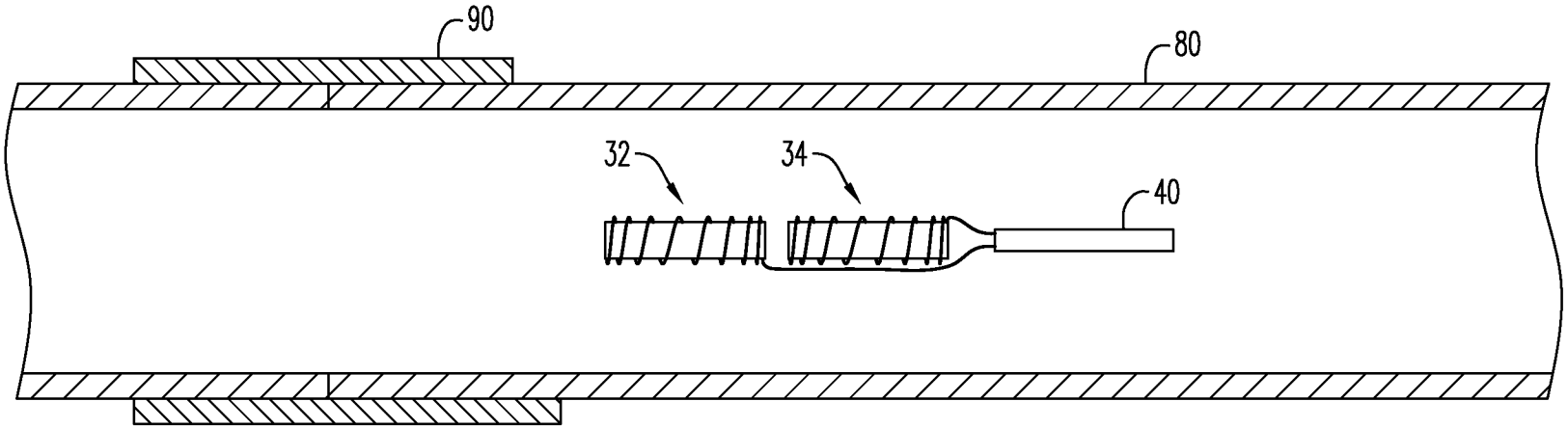
FIG. 14 is a side view of FIG. 13.

FIG. 13 shows wellbore navigation system 10 inside wellbore casing 80. FIG. 14 shows a side view of the same arrangement as FIG. 13. For purposes of clarity, the various structures of untethered drone 300 are not shown in any of the figures showing navigation system 10 inside wellbore casing 80; again, incorporation of navigation system 10 is well understood by one of ordinary skill in the art.

Figure 14A:
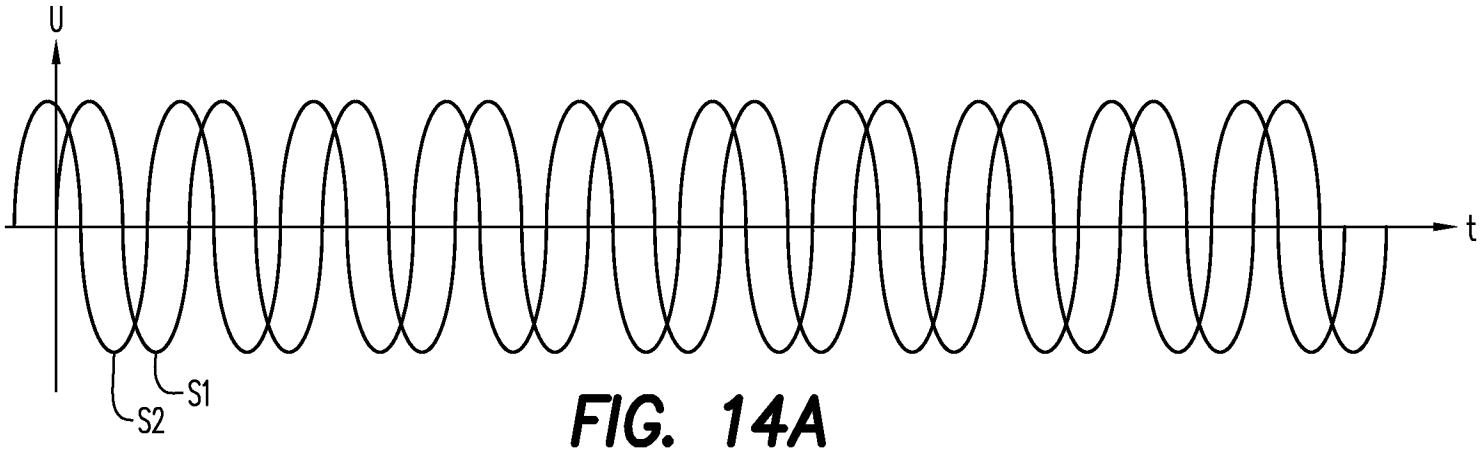
FIG. 14A is a graphical representation of electrical current S1 through coil 32 and electrical current S2 through coil 32 in the navigation system of FIG. 14.

FIG. 14A is a graphical representation of the signal S1, representing the electrical current in first coil 32, and signal S2 represents the electrical current in second coil 34. In at least one embodiment, the phase shift between S1 and S2 may be useful in visualizing S1 and S2 on the same graph. Whether or not navigation system 10 is moving relative to wellbore casing 80 is not material to either S1 or S2. Rather, the only variable being the magnetic permeability of the materials surrounding coils 32, 34, FIG. 14A merely tells us that the inductance value for first coil 32 is equal to the inductance value of second coil 34. From this it can be inferred that the materials surrounding the two coils are the same.

Figure 15:
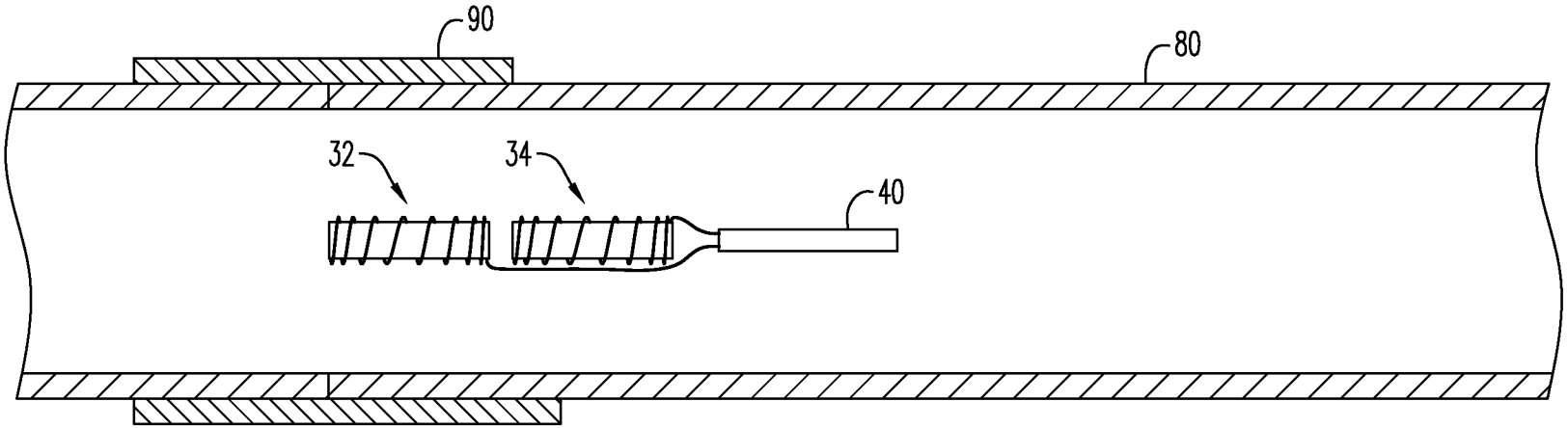
FIG. 15 is a side view of FIG. 13 wherein the navigation system has moved to the left.
Figure 15A:
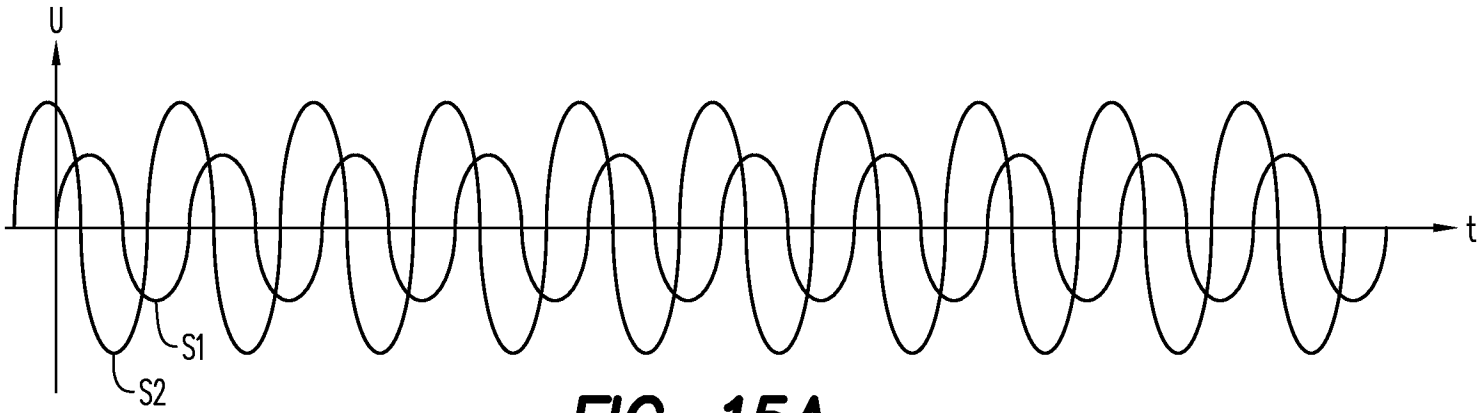
FIG. 15A is a graphical representation of electrical current S1 through coil 32 and electrical current S2 through coil 32 in the navigation system of FIG. 15.

With reference to FIG. 15, it can be seen that the wellbore navigation system 10 has moved relative to its position in FIGS. 13 and 14. Signal S1 in FIG. 15A has a substantially reduced amplitude when compared with signal S1 in FIG. 14A; this tells us that the inductance value for first coil 32 has changed substantially as a result of the movement between FIG. 14 and FIG. 15. Signal S2 in FIG. 15A is not substantially different from signal S2 in FIG. 14A. We can infer from these two facts that the materials surrounding first coil 32 have changed substantially as a result of its movement from its position in FIG. 14 to its position in FIG. 15. We can also infer that the materials surrounding second coil 34 have not changed as a result of this same movement.

Figure 16:
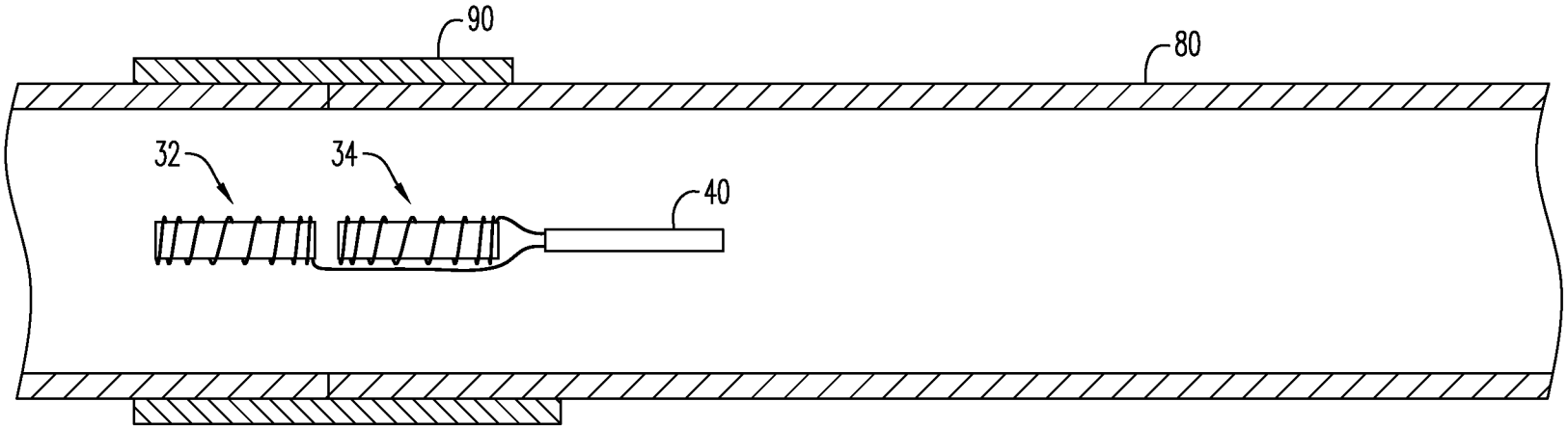
FIG. 16 is a side view of FIG. 13 wherein the navigation system has moved to the left.
Figure 16A:
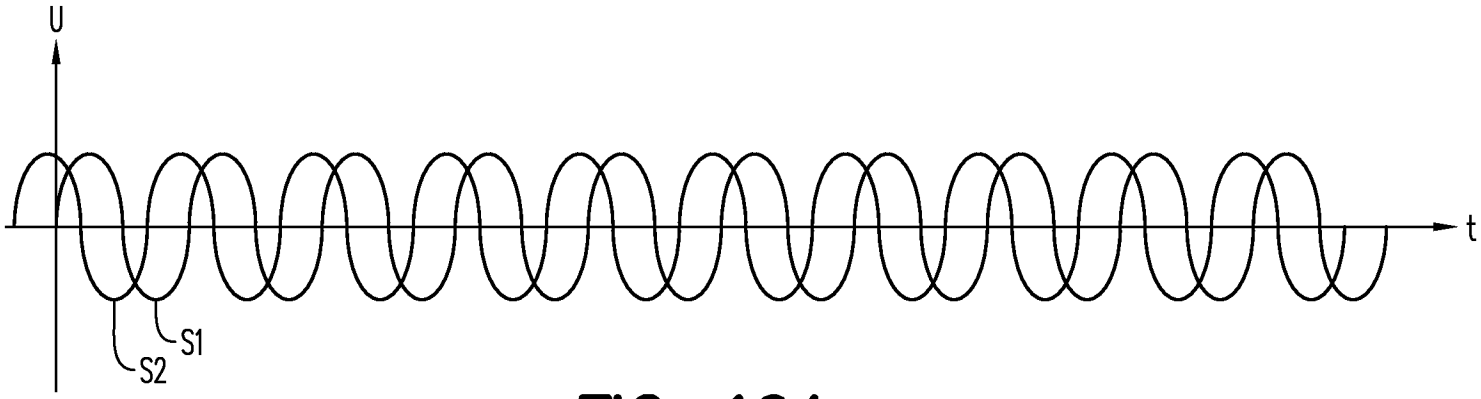
FIG. 16A is a graphical representation of electrical current S1 through coil 32 and electrical current S2 through coil 32 in the navigation system of FIG. 16.

With reference to FIG. 16, it can be seen that wellbore navigation system 10 has continued its movement relative to its positions in FIGS. 14 and 15. Signal S1 in FIG. 16A has a substantially reduced amplitude when compared with signal S1 in FIG. 14A but essentially the same amplitude when compared to signal S1 in FIG. 15A; this tells us that the inductance value for first coil 32 has changed substantially as a result of the movement between FIG. 14 and FIG. 15 but has not changed substantially as a result of the movement between FIG. 15 and FIG. 16. We can infer from these two facts that the materials surrounding first coil 32 changed substantially as a result of its movement from its position in FIG. 14 to its position in FIG. 15 but have not changed as a result of its movement from its position in FIG. 15 to its position in FIG. 16. Signal S2 in FIG. 16A is substantially different from signal S2 in FIG. 14A and FIG. 15A. We can infer from this that the materials surrounding second coil 34 did not change as a result of movement of the second coil from its position in FIG. 14 to FIG. 15 but changed substantially as a result of the movement of second coil 34 from its position in FIG. 15 to its position in FIG. 16.

If we now think of FIGS. 14, 15 and 16 as three snapshots of navigation system 10 as it moves from right to left inside wellbore casing 80, we can extend our inferences based on changing signals S1 and S2. We can infer, first, that when the snapshot depicted in FIG. 14 was taken, first coil 32 and second coil 34 were both located in a section of casing 80 of essentially identical physical properties. Next, we can infer from the snapshot depicted in FIG. 15 that, based on changes to signal S1, navigation system 10 moved and that first coil 32 has entered a section of casing 80 having substantially different physical properties than those found in the previous location, i.e., that shown in FIG. 14. Based on the lack of changes to signal S2, we can infer that second coil 34 has not yet entered the section of casing 80 having substantially different physical properties. We can infer from the snapshot depicted in FIG. 16 and signals in FIG. 16A that first coil 32 remains in a section having substantially different physical properties than those found at the location shown in FIG. 14, i.e., the physical properties around first coil 32 in FIG. 16 are essentially the same as those around the same coil in FIG. 15. Regarding second coil 34, however, based on changes to signal S2 from FIGS. 14A and 15A to FIG. 16A, second coil 34 has entered a section of casing 80 having substantially different physical properties than those found in the previous snapshot locations, i.e., FIGS. 14 and 15. Further, FIG. 16A tells us that first coil 32 and second coil 34 are located in a section of casing 80 of essentially identical physical properties. Comparing FIG. 14A and FIG. 16A, we can see that at least the portion of untethered drone 300 that encompasses both first coil 32 and second coil 34 has passed from one section of casing 80 to a different section of casing 80 having different physical properties.

Figure 17:
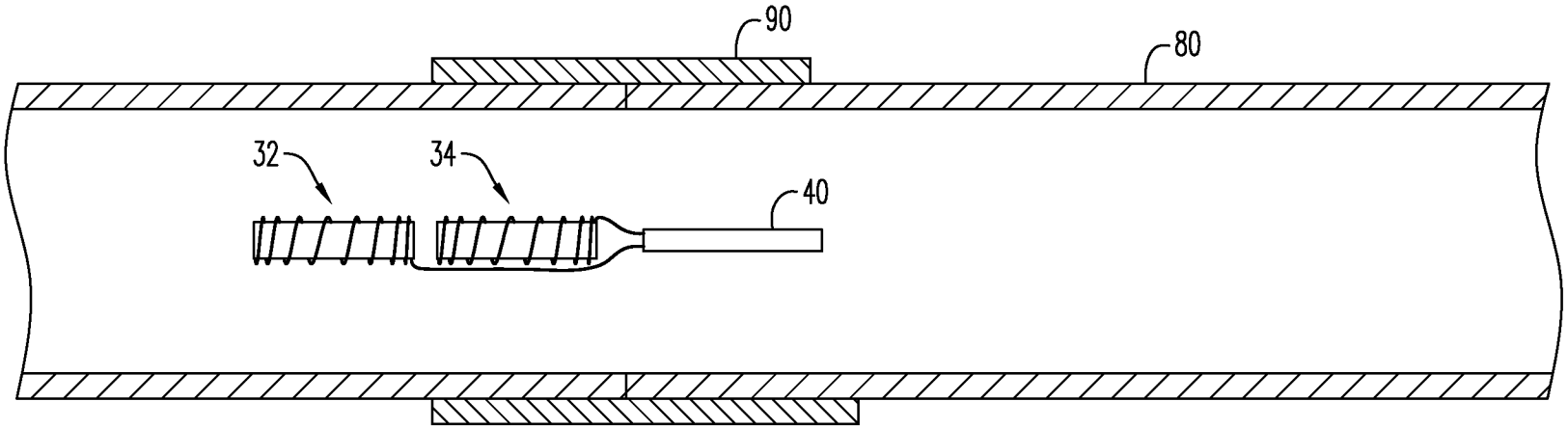
FIG. 17 is a side view of FIG. 13 wherein the navigation system has moved to the left.
Figure 17A:
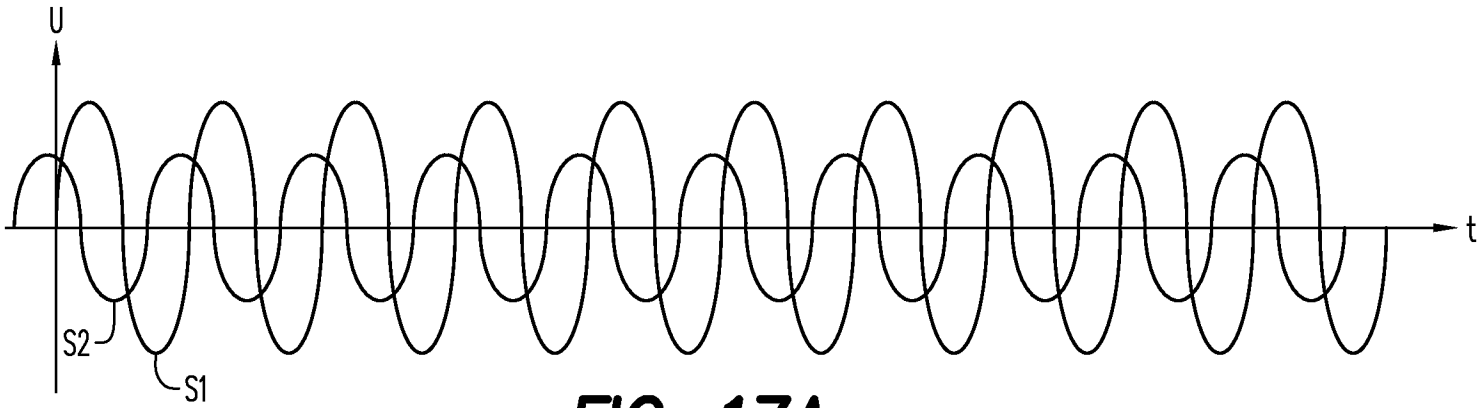
FIG. 17A is a graphical representation of electrical current S2 through coil 32 and electrical current S2 through coil 32 in the navigation system of FIG. 17.
Figure 18:
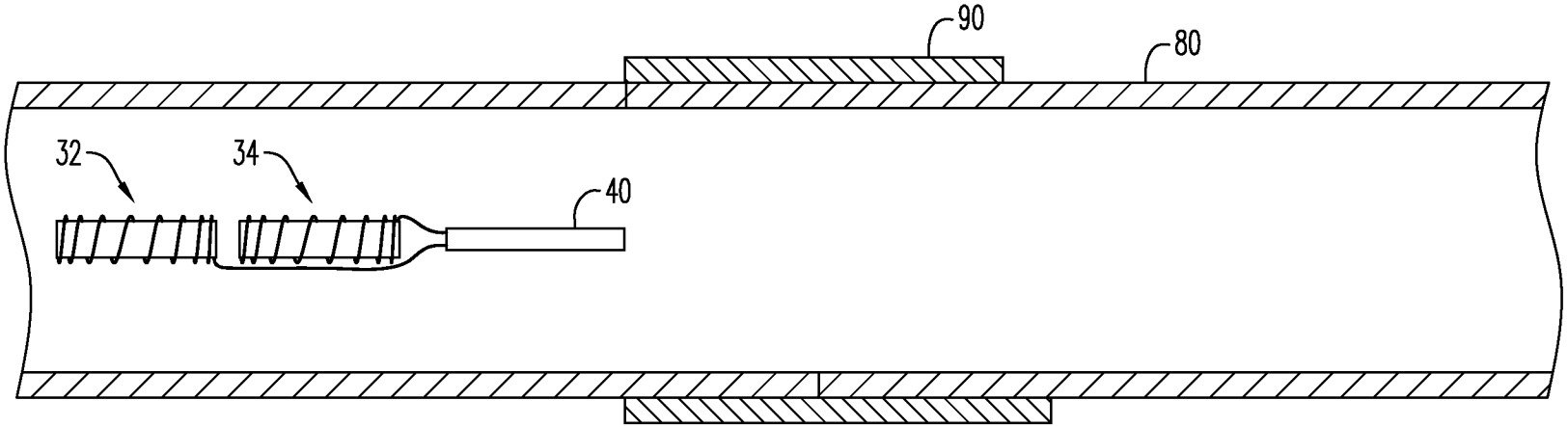
FIG. 18 is a side view of FIG. 13 wherein the navigation system has moved to the left.
Figure 18A:
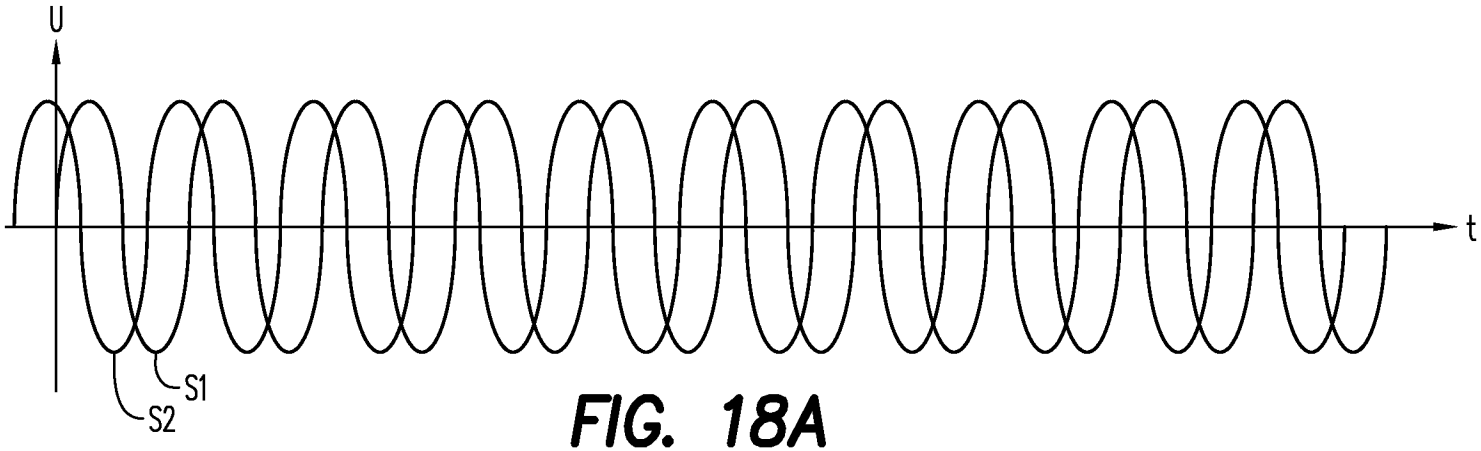
FIG. 18A is a graphical representation of electrical current S1 through coil 32 and electrical current S2 through coil 32 in the navigation system of FIG. 18.

Two additional snapshots of navigation system 10 and its position within wellbore casing 80 are provided in FIGS. 17 and 18. Further, current flow within coils 32 and 34 is provided for each position in FIGS. 17A and 18A. What we are able to infer from changes in S1 and S2 in FIGS. 17A and 18A is simply the reverse of what has been described above regarding FIGS. 15A and 16A. That is, the substantial change to signal S1 and absence of change to signal S2 in FIG. 17A compared to FIG. 16A show that first coil 32 has exited the section of casing 80 having different physical properties but that second coil 34 remains in that section when snapshot FIG. 17 is taken. The absence of change to signal S1 and substantial change to signal S2 in FIG. 18A compared to FIG. 17A show that both first coil 32 and second coil 34 have exited the section of casing 80 having different physical properties when snapshot FIG. 18 is taken. Comparison of FIG. 18A to FIG. 14A may be used to infer that the physical properties surrounding the navigation system 10 when snapshot FIG. 18 is taken are similar to the physical properties surrounding the navigation system 10 when snapshot FIG. 14 is taken.

Embodiments of the present disclosure presents an active oscillating circuit that is able to detect changes in physical properties around an untethered drone 300 as the drone passes through a wellbore 16. The detection is possible at both high and low velocities of the untethered drone 300 through the wellbore 16, while it has been noted that relatively high velocities of the drone movement (e.g., in the range of 5 m/s) result in more accurate readings. Further, passing a drone containing navigation system 10 along a wellbore while recording changes in signals S1 and S2, e.g., with onboard computer 390, will result in a map of changes in physical properties along the length of wellbore 16. This map will enable drones 300 containing a navigation system 10 programmed with the map to navigate the wellbore 16, i.e., know at all times the position of the drone within the wellbore 16.

Besides acting as a verification of first coil 32 passing a change in physical properties, second coil 34 enables an important function of navigation system 10. As we have seen, second coil 34 being displaced axially from first coil 32 along the long axis of untethered drone 300 results in first coil 32 and second coil 34 passing through an area of changed physical properties at different times as untethered drone 300 traverses the wellbore 16. Given a sufficient frequency for signals S1 and S2, as well as sufficiently high sample rate, it is possible to determine the time difference between first coil 32 encountering a particular anomaly, i.e., change in physical properties surrounding the coil, and second coil 34 encountering the same anomaly. The distance between first coil 32 and second coil 34 being a known, a sufficiently precise measurement of time between first 32 and second 34 coils passing a particular anomaly provides a measure of the velocity of the navigation system 10, i.e., velocity equals change in position divided by change in time. Added to the typically safe presumption that the anomaly is stationary, the velocity of the untethered drone 300 through the wellbore 16 is available every time the drone passes an anomaly that returns a sufficient change in amplitude for each of S1 and S2.

As mentioned previously, the potential exists for locating first coil 32 and second coil 34 in different portions of untethered drone 300 and connecting them electrically to signal generating and processing unit 40. As such, it is possible to increase the axial distance between first coil 32 and second coil 34 almost to the limit of the total length of untethered drone 300. Placing first 32 and second 34 coils further away from one another achieves a more precise measure of velocity and retains precision as higher drone velocities are encountered, especially where frequency and sample rate for S1 and S2 reach an upper limit.

An important advantage of the present system is that sensitivity of the detector is greatly increased. Rather than simply being able to detect the presence of a relatively bulky coupling collar 90, the navigation system 10 of the present disclosure has the ability to utilize the presence of many smaller anomalous points found along the length of a typical wellbore 16. While navigation system 10 may register both entry into and exit from each coupling collar 90 along the wellbore 16 and its casing 80, smaller anomalous points will also return sufficient amplitude changes in the current through first coil 32 to register as an anomaly. Importantly, second coil 34 may verify the presence of an anomaly. If, during a window of time related to the velocity of the untethered drone 300 through the wellbore 16, a similar change in amplitude of the current through second coil 34 does not occur, then first coil 32 amplitude change can be ignored.

Further to the foregoing, S1 from first coil 32 and S2 from second coil 34 may be compared by onboard computer 390 using a signal processor and signal filtering circuitry that removes similarities between the two signals and emphasizes differences. An electronic amplifier and filter may be integrated with the onboard computer/processor 390. The amplifier reinforces the raw signal received from the coils while the filter removes noise from the amplified signals developed from the alterations in the resonant frequencies.

Figure 19:
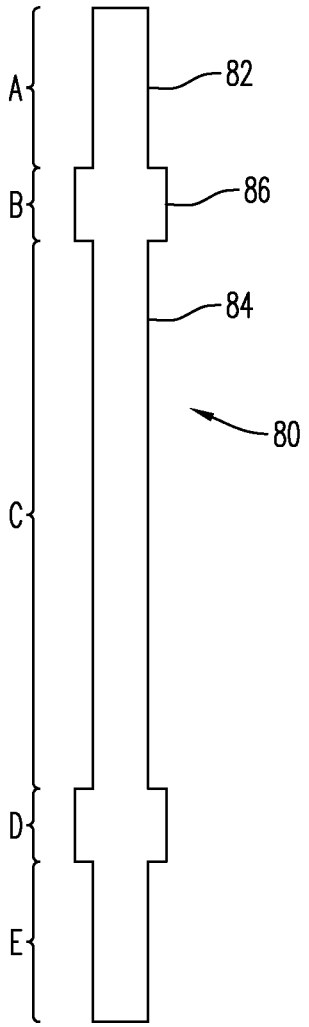
FIG. 19 is a plan view showing several sections of a wellbore casing.
Figure 19A:
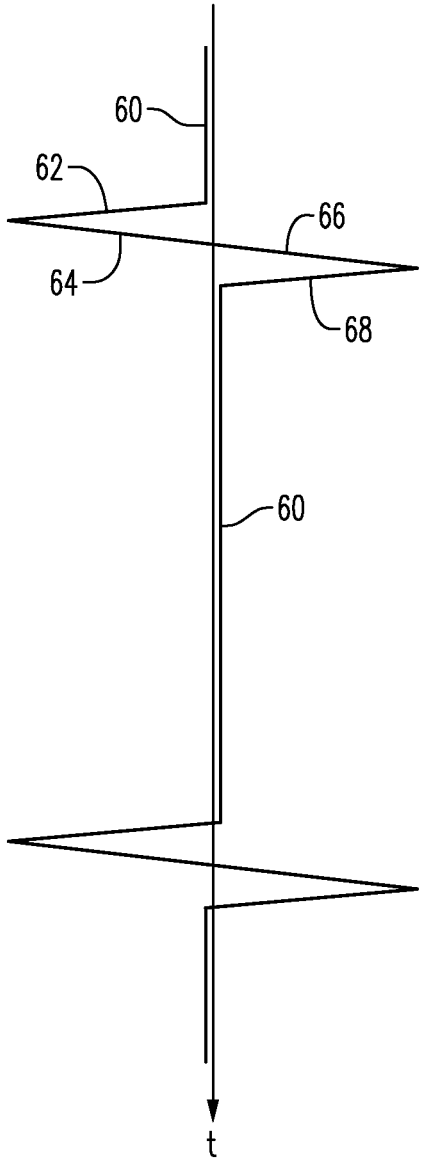
FIG. 19A is a graphical representation of a filtered electrical signal derived from electrical signals S1 and S2 when passing through wellbore casing shown in FIG. 19.

FIG. 19 illustrates a length of wellbore casing 80 wherein an anomaly 86 exists. Prior to anomaly 86 is shown as a first casing portion 82, and subsequent to anomaly 86 is shown as a second casing portion 84. FIG. 19A is a graphical representation of a processed signal that has been filtered and processed to emphasize differences between S1 from first coil 32 and S2 from second coil 34. As both coils 32, 34 traverse section A of the casing 80 the lack of difference between S1 and S2 is seen as the flat line 60. As first coil 32 enters section B, i.e., area of changed physical properties referred to as anomaly 86, the changing amplitude of signal S1 and unchanging amplitude of signal S2 result in signal 62. Once second coil 34 reaches section B, i.e., anomaly 86, signal S2 also begins changing and, as a result, the difference between S1 and S2 starts decreasing because signal S2 'follows' signal S1 once second coil 34 encounters the same anomaly 86. This reduction in difference between S1 and S2 results in signal 64. The signal shown in FIG. 19A passes through zero between signals 64 and 66 when both first coil 32 and second coil 34 are equally affected by anomaly 86. As first coil 32 exits section B, the amplitude difference between the amplitude of S1 and S2 results in signal 66. Exit of second coil 34 from section B results in signal 68. Once both first coil 32 and second coil 34 are past anomaly 86 and again in a more homogenous second casing portion 84, the difference between S1 and S2 should be minimal, as seen in a return to signal 60.

Application of a filter to a processed signal like the one shown in FIG. 19A will result in a number of significant anomalous points along a wellbore 16. Examples of such anomalous points include inconsistencies/heterogeneities in wellbore casing 80. Such heterogeneities will typically be a function of the quality, age and prior use of various sections of casing 80. For example, heterogeneities in casing 80 may be introduced by damage, wear-and-tear, manufacturing defects and designed structures (e.g., coupling collars 90, valves, etc.). Designed structures may even be included as part of the casing for purposes of assisting navigation system 10.

As a result of its increased sensitivity and related self-verifying feature, anomalous points are not limited to heterogeneities associated with the wellbore casing 80. Rather, navigation system 10 may be tuned to have the magnetic fields of its inductors, i.e., first coil 32 and second coil 34, extend beyond the outside diameter of wellbore casing 80. Since air, water, soil, clay, rock, etc, have varying magnetic permeabilities, such wellbore features as entry into the ground and passage between various geological layers are detected as changes in magnetic permeability of the materials surrounding coils 32 and 34. Such transitions as entry of the casing from air into ground and entrance/exit from an aquifer typically present a particularly strong signal. Further, since geological layers typically contain heterogenous sections and/or components such as rocks containing various ores, such heterogeneities close enough to wellbore casing 80 may also be detected by navigation system 10.

The frequency of the active field generated by the coils 32, 34 impacts the resolution measurements of navigation system 10. For a higher velocity of untethered drone 300, a higher signal frequency will result in more accurate measurement of signal changes. However, in the event that higher frequencies may result in shortened battery life for the drone electronics, it may be advisable to have lower frequencies when higher frequencies are not required. Navigation system 10 may dynamically vary signal frequency depending on measured speed changes, utilizing lower frequencies at lower untethered drone 300 velocities to conserve power.

Since toroidal coils 32, 34 occupy a plane, anomalous points are more strongly detected based on how much of the anomaly occupies a plane that is coplanar to coils 32, 34. In an embodiment, two pairs of coils are used; the second pair of coils are rotated 90° about the long axis of the drone. This relationship between the two pairs of coils will provide at least some anomaly detection around the entire circumference of the wellbore casing 80. This multiplication of coils may also be utilized as further verification of anomalous points and add to increases of signal-to-noise ratios.

Figure 20:
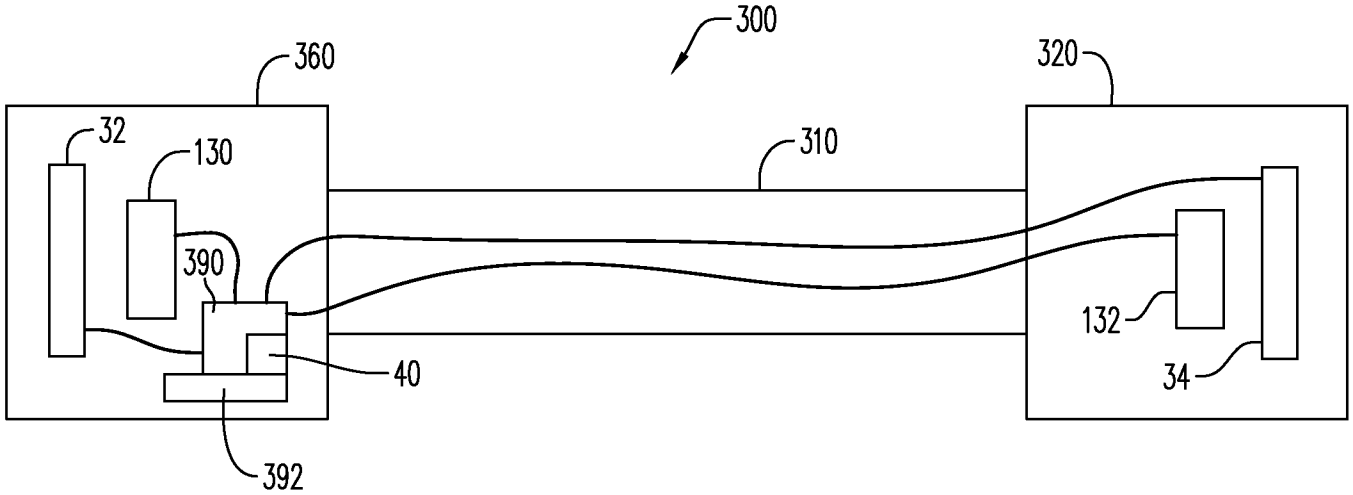
FIG. 20 is a block diagram, cross sectional view of a drone in accordance with an embodiment.

FIG. 20 illustrates an untethered drone 300 including a first ultrasonic transceiver 130, a second ultrasonic transceiver 132, a first coil 32, a second coil 34, an oscillator circuit 40, a power supply 392 and a computer/processor 390. Each of the ultrasonic transceivers 130, 132 and the coils 32, 34 are electrically connected to the computer/processor 390. In addition, the oscillator circuit 40 is either part of computer/processor 390 or connected thereto. Similarly, power supply 392 is either physically or electrically connected to computer/processor 390. The untethered drone 300 shown in FIG. 20 may utilize either or both the ultrasonic transceiver navigation system and the coil/oscillator navigation system presented herein.

The untethered drone 300 disclosed herein and illustrated in FIG. 20, for example, may represent any type of drone. For example, the untethered drone 300 may take the form of the perforating gun shown in FIGS. 2A and 2B. The body portion 310 of the untethered drone 300 may bear one or more shaped charges 340, as illustrated in FIGS. 2A and 2B. As is known in the art, detonation of the shaped charges 340 is typically initiated with an electrical pulse or signal supplied to a detonator. The detonator of the perforating gun embodiment of the untethered drone 300 may be located in the body portion 310 or adjacent the intersection of the body portion 310 and the head portion 320 or the tail portion 360 to initiate the shaped charges 340 either directly or through an intermediary structure such as a detonating cord 350 (FIGS. 2A and 2B).

Obviously, electrical power typically supplied via the wireline cable 12 to wellbore tools, such as a tethered drone or typical perforating gun, would not be available to the untethered drone 300. In order for all components of the untethered drone 300 to be supplied with electrical power, a power supply 392 may be included as part of the untethered drone 300. The power supply 392 may occupy any portion of the drone 300, i.e., one or more of the body 310, head 320 or tail 360. It is contemplated that the power supply 392 may be disposed so that it is conveniently located near components of the drone 300 that require electrical power.

An on-board power supply 392 for a drone 300 may take the form of an electrical battery; the battery may be a primary battery or a rechargeable battery. Whether the power supply 392 is a primary or rechargeable battery, it may be inserted into the drone at any point during construction of the drone 300 or immediately prior to insertion of drone 300 into the wellbore 16. If a rechargeable battery is used, it may be beneficial to insert the battery in an uncharged state and charge it immediately prior to insertion of the drone 300 into the wellbore 16. Charge times for rechargeable batteries are typically on the order of minutes to hours.

In an embodiment, another option for power supply 392 is the use of a capacitor or a supercapacitor. A capacitor is an electrical component that consists of a pair of conductors separated by a dielectric. When an electric potential is placed across the plates of a capacitor, electrical current enters the capacitor, the dielectric stops the flow from passing from one plate to the other plate and a charge builds up. The charge of a capacitor is stored as an electric field between the plates. Each capacitor is designed to have a particular capacitance (energy storage). In the event that the capacitance of a chosen capacitor is insufficient, a plurality of capacitors may be used. When a capacitor is connected to a circuit, a current will flow through the circuit in the same way as a battery. That is, when electrically connected to elements that draw a current the electrical charge stored in the capacitor will flow through the elements. Utilizing a DC/DC converter or similar converter, the voltage output by the capacitor will be converted to an applicable operating voltage for the circuit. Charge times for capacitors are on the order of minutes, seconds or even less.

A supercapacitor operates in a similar manner to a capacitor except there is no dielectric between the plates. Instead, there is an electrolyte and a thin insulator such as cardboard or paper between the plates. When a current is introduced to the supercapacitor, ions build up on either side of the insulator to generate a double layer of charge. Although the structure of supercapacitors allows only low voltages to be stored, this limitation is often more than outweighed by the very high capacitance of supercapacitors compared to standard capacitors. That is, supercapacitors are a very attractive option for low voltage/high capacitance applications as will be discussed in greater detail hereinbelow. Charge times for supercapacitors are only slightly greater than for capacitors, i.e., minutes or less.

A battery typically charges and discharges more slowly than a capacitor due to latency associated with the chemical reaction to transfer the chemical energy into electrical energy in a battery. A capacitor is storing electrical energy on the plates so the charging and discharging rate for capacitors are dictated primarily by the conduction capabilities of the capacitors plates. Since conduction rates are typically orders of magnitude faster than chemical reaction rates, charging and discharging a capacitor is significantly faster than charging and discharging a battery. Thus, batteries provide higher energy density for storage while capacitors have more rapid charge and discharge capabilities, i.e., higher power density, and capacitors and supercapacitors may be an alternative to batteries especially in applications where rapid charge/discharge capabilities are desired.

Thus, an on-board power supply 392 for a drone 300 may take the form of a capacitor or a supercapacitor, particularly for rapid charge and discharge capabilities. A capacitor may also be used to provide additional flexibility regarding when the power supply is inserted into the drone 300, particularly because the capacitor will not provide power until it is charged. Thus, shipping and handling of a drone 300 containing shaped charges 430 or other explosive materials presents low risks where an uncharged capacitor is installed as the power supply 392. This is contrasted with shipping and handling of a drone 300 with a battery, which can be an inherently high-risk activity and frequently requires a separate safety mechanism to prevent accidental detonation. Further, and as discussed previously, the act of charging a capacitor is very fast. Thus, the capacitor or supercapacitor being used as a power supply 392 for drone 300 can be charged immediately prior to deployment of the drone 300 into the wellbore 16.

While the option exists to ship a drone 300 preloaded with a rechargeable battery which has not been charged, i.e., the electrochemical potential of the rechargeable battery is zero, this option comes with some significant drawbacks. The goal must be kept in mind of assuring that no electrical charge is capable of inadvertently accessing any and all explosive materials in the drone 300. Electrochemical potential is often not a simple, convenient or failsafe thing to measure in a battery. It may be the case that the potential that a 'charged' battery may be mistaken for an 'uncharged' battery simply cannot be reduced sufficiently to allow for shipping a drone 300 with an uncharged battery. In addition, as mentioned previously, the time for charging a rechargeable battery having adequate power for drone 300 could be on the order of an hour or more. Currently, fast recharging batteries of sufficient charge capacity are uneconomical for the 'one-time-use' or 'several-time-use' that would be typical for batteries used in drone 300.

In an embodiment, electrical components like the computer/processor 390, the oscillator circuit 40, the coils 32, 34, and the ultrasonic transceivers 130, 132 may be battery powered while explosive elements like the detonator for initiating detonation of the shaped charges 340 are capacitor powered. Such an arrangement would take advantage of the possibility that some or all of the computer/processor 390, the oscillator circuit 40, the coils 32, 34, and the ultrasonic transceivers 130, 132 may benefit from a high-density power supply having higher energy density, i.e., a battery, while initiating elements such as detonators typically benefit from a higher power density, i.e., capacitor/supercapacitor. A very important benefit for such an arrangement is that the battery is completely separate from the explosive materials, affording the potential to ship the drone 300 preloaded with a charged or uncharged battery. The power supply that is connected to the explosive materials, i.e., the capacitor/supercapacitor, may be very quickly charged immediately prior to dropping drone 300 into wellbore 50.

In order for an untethered perforating drone 300 to be aware of exactly when to initiate the detonation or begin the initiation sequence downhole, some type of depth-correlation may be used. Also, it may be useful for the drone 300 to be aware of its rotational or angular position or angular speed relative to the longitudinal axis of the wellbore, for example, to orient perforating charges in a particular direction, or to confirm that the drone 300 is not rotating prior to initiation. With reference to FIGS. 21A-24B, in accordance with another aspect, a wellbore positioning system includes one or more casing elements 402, such as downhole tubulars or casing pipes, or their coupling joints, that have a unique or specifically defined magnetic patterns or signatures 406, 408, and 410 prior to being assembled and then placed and cemented inside a wellbore.

The magnetic patterns 406, 408, and 410 may be applied to the casing elements 402 on the surface at the well-site or in an assembly factory environment, using a magnetizing machine which can apply defined magnetic patterns to pipe or tubular (i.e., cylindrical) structures. In embodiments, the magnetic patterns 406, 408, and 410 are applied directly to the pipe without the need for any other structure being physically applied or attached to the well casing elements 402. The magnetic patterns or signatures 406, 408, and 410 may be robust enough to withstand impact, vibration, and elevated temperatures up to 150 C without losing its unique identity.

The magnetic signature and pattern may be recognizable and registered as such by a onboard computer (e.g., computer/processor 390) of a drone 300 when travelling downhole along a pathway defined by an interior surface of well casing elements 402. The magnetic pattern would be clear and have a unique structure so it clearly identifiable and it would not be mistaken with any other magnetic objects or magnetic field downhole.

By placing the magnetic patterns or signatures 406, 408, and 410 at pre-defined intervals or lengths along the wellbore, the computer (e.g., computer/processor 390) can compute in real-time an actual depth of the drone 300 inside the wellbore while the drone 300 is travelling down-hole in the wellbore. For example, in an embodiment where the magnetic patterns or signatures 406, 408, and 410 are placed at pre-defined intervals or lengths, the computer/processor 390 and drone 300 may be pre-programmed on the surface to initiate one or more operations at a specific depth inside the wellbore once a corresponding number of magnetic signature patterns or signatures 406, 408, and 410 have been counted during travel of the drone. Also, by counting an elapsed time between spaced magnetic patterns or signatures 406, 408, and 410 the computer/processor 390 may calculate an axial velocity of the drone 300 traveling between the spaced magnetic patterns or signatures 406, 408, and 410.

Figure 21A:
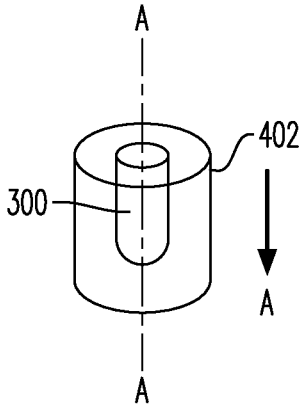
FIG. 21A is a schematic view of an embodiment of a portion of a wellbore positioning system that includes a well casing element in accordance with this disclosure.

An exemplary embodiment of part of a wellbore positioning system will now be described with reference to FIG. 21A. The exemplary embodiment according to FIG. 21A is illustrative and not limiting, and exemplary features may be referenced throughout this disclosure. In FIG. 21A a well casing element 402 is shown. The well casing element 402 is configured for insertion into a wellbore and is configured to fluidly connect to other well casing elements (whether magnetized or non-magnetized) as part of a string of wellbore casing elements. As noted above, the well casing element 402 may be a downhole tubular or casing pipe, or a coupling joint for downhole tubulars or casing pipes. The well casing element 402 extends longitudinally along a central axis A-A. Arrow A indicates a travel direction of the drone parallel to axis A-A. While the arrow A indicates one direction, it will be appreciated that the direction of travel may be bidirectional or unidirectional and opposite the direction shown in FIG. 21A. The well casing element 402 has an outer surface and an inner surface. The outer surface is configured to face the wellbore when the well casing element is inserted into the wellbore. The interior surface defines an interior space or pathway for travel of the drone 300 in the direction of the arrow A.

Thus, at least a portion of the well casing element 402 shown in FIG. 21A may be magnetized with a magnetic pattern or signature 406 that generates magnetic fields on the outer surface of the portion of the well casing element 402. Alternatively, the well casing element 402 may be magnetized with a magnetic pattern or signature 406 on the inner surface of the well casing element 402. The magnetic pattern or signature 406 can encode information related to the depth of the well casing element and/or other information such as a relative angular position of the drone 300.

Figure 21B:
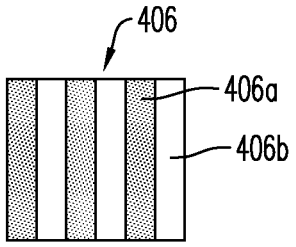
FIG. 21B is a depiction of a magnetic pattern of a portion of the well casing element shown in FIG. 21A.

As shown in FIG. 21B, the magnetic pattern or signature 406 is parallel to the direction of travel (noted by arrow A) of the drone 300 and axis A-A; i.e., the magnetic pattern or signature 406 is constant along the direction of travel and varies in a circumferential direction around the axis A-A. In other words, the magnetic signature 406 may include alternating magnetized regions (406*a*) and unmagnetized regions (406*b*) that extend in a direction parallel to axis A-A. The change in magnetic fields of the magnetic signature 406 can be detected by the drone 300 as anomalies and processed to determine position information as described above. Such anomalies can be detected as the drone 300 or a detector inside the drone 300 rotates relative to the wellbore casing element 402. Having a magnetic signature shown in FIG. 21B can allow the drone 300 to determine angular velocity of the drone 300 relative to the casing element 402, which can be used to determine whether or not to perform an operation of a tool of a tool string connected to the drone, such as to detonate charges of a perforating gun.

Figure 22A:
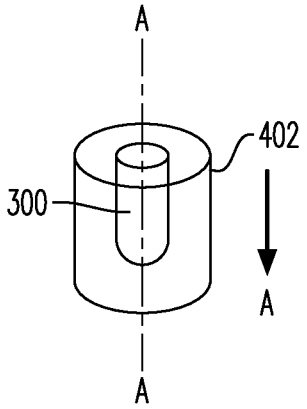
FIG. 22A is a schematic view of an embodiment of a portion of a wellbore positioning system that includes a well casing element in accordance with this disclosure.
Figure 22B:
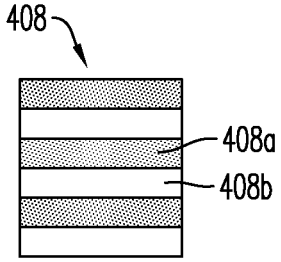
FIG. 22B is a depiction of a magnetic pattern of a portion of the well casing element shown in FIG. 22A.

Alternatively, as shown in an embodiment shown in FIGS. 22A and 22B, the well casing element 402 can be magnetized with magnetic pattern or signature 408 that is perpendicular to the direction of travel (noted by arrow A) and axis A-A, i.e., the magnetic pattern or signature 408 varies along the direction of travel. In other words, the magnetic signature 408 may include alternating magnetized regions (408*a*) and unmagnetized regions (408*b*) that extend circumferentially around the well casing element 402. The change in magnetic fields of the magnetic pattern or signature 408 can be detected by the drone 300 as anomalies and processed as position information as described above. Such anomalies can be detected as the drone 300 moves axially in the direction of arrow A. Having a magnetic pattern or signature 408 shown in FIG. 22B can allow the drone 300 to detect an axial position of the drone 300 in the wellbore corresponding to the detected magnetic signature 408. Also, a measurement of elapsed time between detection of axial positions corresponding to multiple magnetic signatures 408 may also permit a determination of the axial velocity of the drone 300.

The magnetic signature 408 may provide relative or absolute information on a position of the drone 300 within the wellbore. For example, to provide relative information, the magnetic signature 408 may be provided at regular intervals along the well casing elements 402. If it is known that the magnetic signatures 408 are provided, for example, every 10 meters on well casing elements 402, then the drone 300 may be programmed to track its position and increment its position by 10 meters every time a magnetic signature 408 is detected. It will be understood that the 10 meter increment is provided as merely an illustrative example, and that the disclosure is not limited to this distance.

Figure 22C:
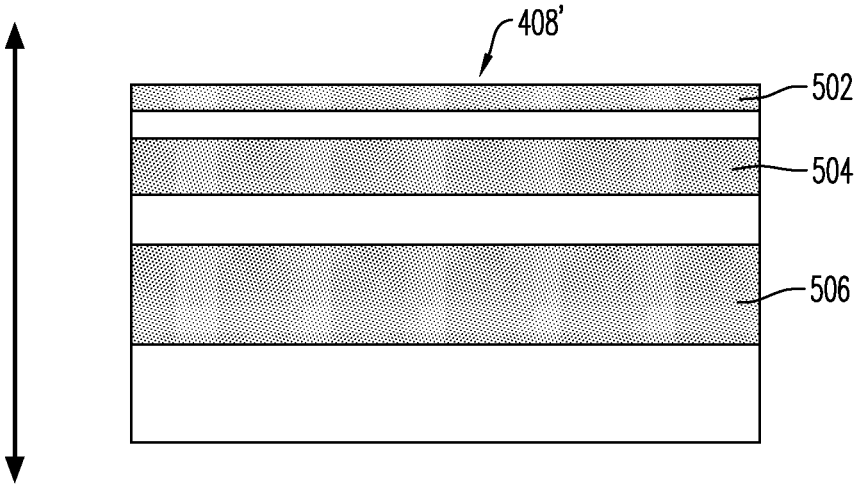
FIG. 22C is a depiction of an alternate embodiment of the magnetic pattern shown in FIG. 22B.

Additionally, the pattern of the magnetic signature 408 may be configured to indicate a direction of passage as the drone 300 passes the magnetic signature 408. For example, as shown in FIG. 22C, an alternative magnetic signature 408' has a first magnetized region 502, a second magnetized region 504, and a third magnetized region 506, each having a different predetermined width in the axial direction, and may be arranged in a certain or preprogrammed pattern. Depending on the order in which the drone 300 detects the first magnetized region 502, the second magnetized region 504, and the third magnetized region 506, it can be determined whether the drone 300 is travelling in an uphole or downhole direction.

Figure 23:
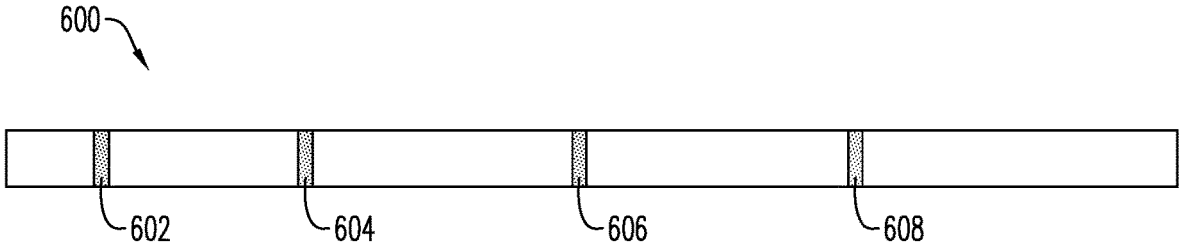
FIG. 23 is a schematic view of an embodiment of a portion of a wellbore positioning system having a string of well casing elements with unique magnetic patterns spaced apart certain distances.

FIG. 23 shows an exemplary embodiment that may provide absolute position information within a wellbore 600. For example, a first unique magnetic pattern 602, a second unique magnetic pattern 604, a third unique magnetic pattern 606, and a fourth unique magnetic pattern 608 may be provided on the wellbore casing. Each unique magnetic pattern may include a different pattern of magnetized regions, such as a different number of magnetized regions, varying widths of magnetized regions, or a combination of both. The magnetic patterns 602, 604, 606, and 608 may, for example, be any of the specific exemplary patterns described herein. The drone 300 may be preprogrammed to correlate each unique pattern 602, 604, 606, and 608 with a particular position within the wellbore 600; accordingly, upon detecting a particular one of the unique magnetic patterns, the drone 300 will be able to determine its absolute position within the wellbore 600. The unique magnetic patterns 602, 604, 606, and 608 may be regularly spaced or irregularly spaced throughout the wellbore 600. It will be understood the four unique magnetic patterns 602, 604, 606, and 608 shown in FIG. 23 are for illustrative purposes only, and that any number of unique magnetic patterns may be used.

Figure 24A:
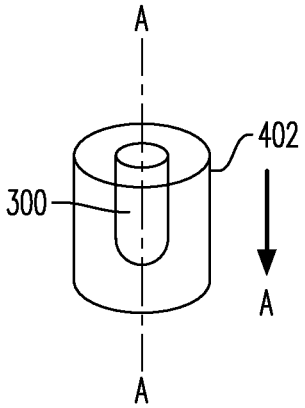
FIG. 24A is a schematic view of an embodiment of a portion of a wellbore positioning system that includes a well casing element in accordance with this disclosure.
Figure 24B:
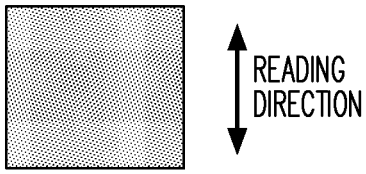
FIG. 24B is a depiction of a magnetic pattern of the well casing element shown in FIG. 24A.

With reference to FIG. 24A, in another embodiment in accordance with this disclosure, a complete section of a well casing element 402 may be magnetized to a specific field strength with magnetic pattern or signature 410. The complete section (e.g., complete length of pipe or a complete collar) of magnetized well casing element 402 may be located at a specific position along a string of connected well casing elements, which may correspond to a specific depth or absolute position withing the wellbore when the string is installed in the wellbore. The entire outer surface or entire inner surface of the wellbore casing element 402 may be magnetized with the magnetic pattern or signature 410. In FIG. 24B, the magnetic pattern or signature 410 is read perpendicular to the direction of travel of the drone 300.

Figure 24C:
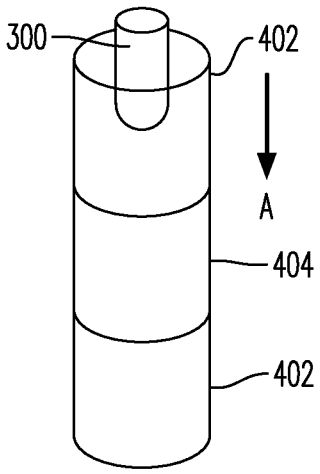
FIG. 24C is a schematic view of an embodiment of a portion of a wellbore positioning system that includes a string of well casing elements in accordance with an aspect of this disclosure.
Figure 24D:
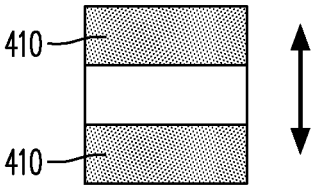
FIG. 24D is a depiction of the magnetic patterns of two well casing elements of the string of well casing elements shown in FIG. 24C.

With reference to FIG. 24C, in one embodiment, multiple fully magnetized sections of well casing elements 402, such as those shown in FIG. 23A, can be spaced apart by an unmagnetized connecting well casing element 404. Similar to the distance between the patterns 502, 504, and 506 discussed above, in the embodiment shown in FIGS. 24C and 24D, the distance between the spaced, fully magnetized sections of well casing elements 402, and therefore, the spacing between patterns 410, may be a specific preprogrammed distance which can facilitate detection of the magnetic patterns 410 by the drone 300 as it travels by the magnetized and unmagnetized well casing elements 402 and 404, i.e., in a direction of arrow A.

Figure 25:
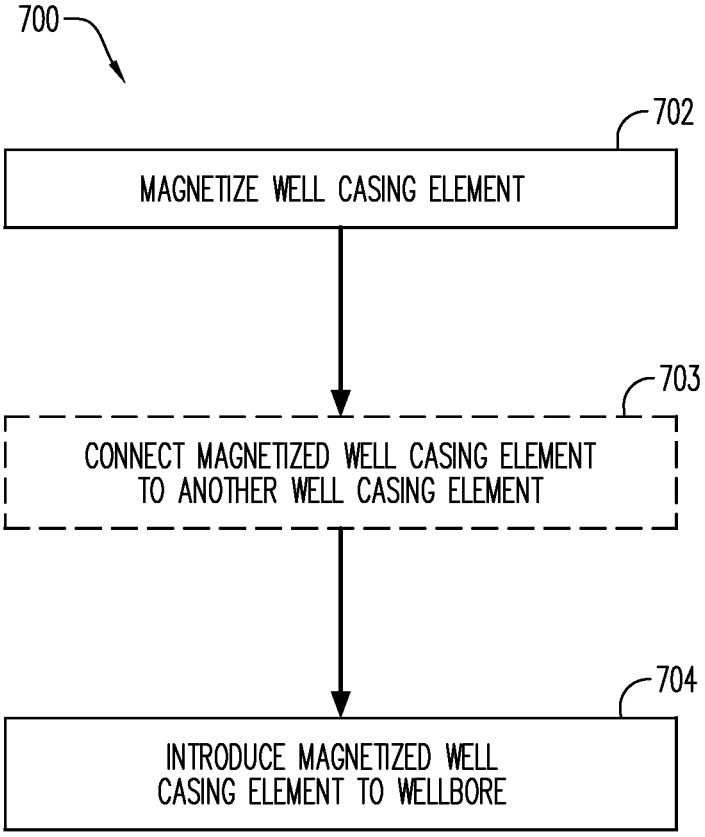
FIG. 25 is a workflow for constructing a wellbore positioning system in accordance with an aspect of this disclosure.

According to another aspect, a method of constructing a wellbore positioning system is described with reference to a workflow 700 shown in FIG. 25. At 702, a magnetic pattern, such as those described hereinabove, is applied to a well casing element 402 on the surface (not downhole in the wellbore) at the well-site or in an assembly factory environment, using a magnetizing machine which can apply defined magnetic patterns to well casing elements, such as pipe or cylindrical structures. At 704, the magnetized well casing element may be inserted into the wellbore during the well casing and completion process. Optionally, before being inserted into the wellbore, the magnetized well casing element may be connected to another well casing element at 703 making up a string of well casing elements.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make substitutions possible that are not now contemplated by reason of the imprecision of language; these variations should be covered by the appended claims. This written description uses examples to disclose the method, machine and computer-readable medium, including the exemplary embodiments, and also to enable any person of skill in the art to practice these, including making and using any devices or systems and performing any incorporated methods. The patentable scope thereof is defined by the claims, and may include other examples that occur to those of skill in the art. Such other examples are intended to be within the scope of the claims if, for example, they have structural elements that do not differ from the literal language of the claims, or if they include structural elements with insubstantial differences from the literal language of the claims.

What is claimed is:

1. A wellbore positioning system comprising:

a first wellbore casing element bearing a first magnetic pattern that encodes first information associated with a wellbore or a drone, the first wellbore casing element being configured for placement down-hole in the wellbore, the first wellbore casing element extending along a central axis and defining an axially oriented passage; and an untethered drone configured for relative movement in the passage of the first wellbore casing element, the drone configured to detect the first magnetic pattern and determine a position of the drone within the wellbore based on the first information.

2. The system of claim 1, wherein:

the first wellbore casing element is one of a pipe or casing collar, and at least a portion of the first wellbore casing element is magnetized with the first magnetic pattern.

3. The system of claim 1, further comprising a wellbore tool connected to the drone, the drone configured to position the wellbore tool relative to the wellbore based in part on the first encoded information.

4. The system of claim 1, wherein the first magnetic pattern is on an outer surface of the first wellbore casing element.

5. The system of claim 4, wherein the first magnetic pattern varies along a direction of the central axis.

6. The system of claim 4, wherein the first magnetic pattern varies along a circumferential direction with respect to the central axis.

7. The system of claim 1, wherein the first magnetic pattern is on an inner surface of the first wellbore casing element.

8. The system of claim 7, wherein the first magnetic pattern varies along a direction of the central axis.

9. The system of claim 7, wherein the first magnetic pattern varies along a circumferential direction with respect to the central axis.

10. The system of claim 1, wherein:

the first wellbore casing element has a length that extends from a first end to a second end along the central axis and the first magnetic pattern extends from the first end to the second end, and wherein the first magnetic pattern of the first wellbore casing element varies along a direction of the central axis.

11. The system of claim 1, further comprising a second wellbore casing element bearing a second magnetic pattern that encodes second information associated with the wellbore or a drone, the second wellbore casing element being configured for placement down-hole in the wellbore in axially spaced relation to the first wellbore casing element, the second wellbore casing element extending along the central axis, and wherein the second wellbore casing element has a length that extends from a first end to a second end along the central axis and the second magnetic pattern extends from the first end to the second end, and wherein the second magnetic pattern of the second wellbore casing element varies along a direction of the central axis.

12. The system of claim 11, further comprising a third wellbore casing element fluidly coupling the first and second wellbore casing elements and disposed axially therebetween, the third wellbore casing element having a certain length and being substantially unmagnetized.

13. A method of constructing a wellbore positioning system, comprising:

providing a wellbore casing element above the surface of a wellbore, the wellbore casing element being configured for placement down-hole in the wellbore, the wellbore casing element extending along a central axis and defining an axially oriented passage;

magnetizing at least a portion of the wellbore casing element with a magnetic pattern that encodes first information associated with the wellbore; and inserting the magnetized wellbore casing element into the wellbore.

14. The method according to claim 13, wherein the magnetic pattern is on an outer surface of the first wellbore casing element.

15. The method of claim 14, wherein the magnetic pattern varies along a direction of the central axis.

16. The method of claim 14, wherein the magnetic pattern varies along a circumferential direction with respect to the central axis.

17. The method of claim 13, wherein the magnetic pattern is on an inner surface of the first wellbore casing element.

18. The method of claim 17, wherein the magnetic pattern varies along a direction of the central axis.

19. The method of claim 17, wherein the magnetic pattern varies along a circumferential direction with respect to the central axis.

20. The method of claim 13, wherein the wellbore casing element has a length that extends from a first end to a second end along the central axis and magnetizing includes magnetizing substantially the entire length of wellbore casing element to a specific field strength, and wherein the magnetic pattern of the first wellbore casing element varies along a direction of the central axis.

* * * * *